US012758843B2

(12) United States Patent
Demkowski et al.

(10) Patent No.: US 12,758,843 B2
(45) **Date of Patent: *Oct. 13, 2026**

(54) GOLF CLUB HEAD

(71) Applicant: Taylor Made Golf Company, Inc., Carlsbad, CA (US)

(72) Inventors: Paul M. Demkowski, Cardiff, CA (US); Bret H. Wahl, Escondido, CA (US); Sean Toulon, Vista, CA (US); Marni D. Ines, San Marcos, CA (US); Robert Nunez, Vista, CA (US); Bill Price, Santa Ana, CA (US); Jose Miraflor, Oceanside (CA)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/574,595

(22) Filed: Mar. 23, 2026

(65) Prior Publication Data

US 2026/0199764 A1 Jul. 16, 2026

Related U.S. Application Data

(63) Continuation of application No. 19/345,718, filed on Sep. 30, 2025, now Pat. No. 12,667,765, which is a continuation of application No. 19/015,217, filed on Jan. 9, 2025, now Pat. No. 12,478,850, which is a continuation of application No. 18/370,314, filed on Sep. 19, 2023, which is a continuation of application No. 18/140,184, filed on Apr. 27, 2023, now Pat. No. 12,268,945, which is a continuation of application No. 17/107,490, filed on Nov. 30, 2020, now Pat. No. 11,673,035, which is a continuation of application No. 16/886,273, filed on May 28, 2020, now Pat. No. 10,874,928, which is a continuation of application No. 16/248,190, filed on Jan. 15, 2019, now Pat. No. 10,668,351, which is a continuation of application No. 15/697,291, filed on Sep. 6, 2017, now Pat. No.

(Continued)

(51) Int. Cl.
*A63B 69/36* (2006.01)
*A63B 53/04* (2015.01)

(52) U.S. Cl.
CPC ..... *A63B 69/3685* (2013.01); *A63B 53/04* (2013.01); *A63B 53/0408* (2020.08); *A63B 53/0487* (2013.01); *A63B 53/0416* (2020.08); *A63B 53/0437* (2020.08); *A63B 53/0441* (2020.08); *A63B 2209/00* (2013.01)

(58) Field of Classification Search
CPC . A63B 69/3685; A63B 53/04; A63B 53/0487; A63B 53/0416; A63B 53/0437; A63B 53/0441; A63B 53/0408; A63B 2209/00; A63B 2053/0491
USPC ..... 473/324–350, 287–292
See application file for complete search history.

(56) References Cited

U.S. PATENT DOCUMENTS 6,716,110 B1 4/2004 Ballow
D501,233 S 1/2005 Thomas (Continued)

*Primary Examiner* — Sebastiano Passaniti
(74) *Attorney, Agent, or Firm* — Dawsey Co., LPA; David J. Dawsey

(57) ABSTRACT

A golf club putter head having a top portion, a sole portion, a front portion with a striking surface, a heel side portion, and a toe side portion, wherein a central portion extends rearwardly from the front.

35 Claims, 14 Drawing Sheets

Related U.S. Application Data

10,252,138, which is a continuation of application No. 14/728,928, filed on Jun. 2, 2015, now Pat. No. 9,827,479, which is a continuation of application No. 13/943,496, filed on Jul. 16, 2013, now Pat. No. 9,044,662, which is a continuation of application No. 13/708,785, filed on Dec. 7, 2012, now Pat. No. 8,758,154, which is a continuation of application No. 12/690,861, filed on Jan. 20, 2010, now Pat. No. 8,328,654.

(60) Provisional application No. 61/205,647, filed on Jan. 21, 2009.

(56) References Cited

U.S. PATENT DOCUMENTS

| | | | | |
|---|---|---|---|---|
| 6,974,394 | B1 | 12/2005 | Tang | |
| D533,609 | S | 12/2006 | Thomas | |
| D541,362 | S | 4/2007 | Oldknow | |
| D542,872 | S | 5/2007 | Oldknow | |
| 7,278,926 | B2 * | 10/2007 | Frame | A63B 53/0487 473/331 |
| D557,361 | S | 12/2007 | Rollinson | |
| D574,457 | S | 8/2008 | Stites | |
| 7,407,443 | B2 | 8/2008 | Franklin | |
| 7,455,599 | B2 | 11/2008 | Jones | |
| D582,497 | S | 12/2008 | Rollinson | |
| D600,295 | S | 9/2009 | Meeks | |
| D600,762 | S | 9/2009 | Serrano | |
| 7,594,865 | B2 | 9/2009 | Ines | |
| D607,952 | S | 1/2010 | Demkowski | |
| 7,648,425 | B2 | 1/2010 | Wahl | |
| 7,682,263 | B2 | 3/2010 | Yamamoto | |
| D623,710 | S | 9/2010 | Hilton | |
| D643,485 | S | 8/2011 | Nicolette | |
| 8,246,481 | B2 | 8/2012 | Stites | |
| 8,328,654 | B2 | 12/2012 | Demkowski | |
| 9,144,717 | B2 | 9/2015 | Franklin | |
| 12,667,765 | B2 * | 6/2026 | Demkowski | A63B 60/02 |
| 2004/0121853 | A1 * | 6/2004 | Caldwell | A63B 60/00 473/345 |
| 2005/0130764 | A1 * | 6/2005 | Frame | A63B 53/0487 473/340 |
| 2005/0137027 | A1 | 6/2005 | Thomas | |
| 2008/0009367 | A1 | 1/2008 | Johnson | |

* cited by examiner

GOLF CLUB HEAD

CROSS-REFERENCE TO RELATED APPLICATIONS

This application is a continuation of U.S. patent application Ser. No. 19/345,718, filed Sep. 30, 2025, which a continuation of U.S. patent application Ser. No. 19/015,217, filed Jan. 9, 2025, now U.S. Pat. No. 12,478,850, which is a continuation of U.S. patent application Ser. No. 18/370,314, filed Sep. 19, 2023, which is a continuation of U.S. patent application Ser. No. 18/140,184, filed Apr. 27, 2023, now U.S. Pat. No. 12,268,945, which is a continuation of U.S. patent application Ser. No. 17/107,490, filed Nov. 30, 2020, now U.S. U.S. Pat. No. 11,673,035, which is a is a continuation of U.S. patent application Ser. No. 16/886,273, filed May 28, 2020, now U.S. Pat. No. 10,874,928, which is a continuation of U.S. patent application Ser. No. 16/248,190, filed Jan. 15, 2019, now U.S. Pat. No. 10,668,351, which is a continuation of U.S. patent application Ser. No. 15/697,291, filed Sep. 6, 2017, now U.S. Pat. No. 10,252,138, which is a continuation of U.S. patent application Ser. No. 14/728,928, filed Jun. 2, 2015, now U.S. Pat. No. 9,827,479, which is a continuation of U.S. patent application Ser. No. 13/943,496, filed Jul. 16, 2013, now U.S. Pat. No. 9,044,662, which is a continuation of U.S. patent application Ser. No. 13/708,785, filed Dec. 7, 2012, now U.S. Pat. No. 8,758,154, which is a continuation of U.S. patent application Ser. No. 12/690,861, filed Jan. 20, 2010, now U.S. Pat. No. 8,328,654, which claims priority to and benefit of U.S. Provisional Patent Application No. 61/205,647, filed Jan. 21, 2009, all of which are incorporated herein by reference in their entirety.

FIELD

The disclosure pertains to the field of golf club heads and more particularly, but not exclusively, to putter-type golf club heads.

BACKGROUND

Golf is a game in which a player, using many types of clubs, hits a ball into each hole or cup on a golf course in the lowest possible number of strokes. When a golf club face contacts a golf ball off-center, the club head can twist about the center of gravity causing the golf ball to travel in an unintended direction. Moreover, the club head twisting can cause the ball to skid across a surface rather than roll forward in a smooth manner.

A putter-type golf club is generally used from a very close distance on a putting green. Putter-type golf clubs are used by a golfer when a great deal of accuracy and precision are required for each shot.

Most golf putters are provided with a smooth ball-striking face, with greater or lesser degree of loft in order to control the distance and direction that a struck golf ball travels. Generally, a golf ball struck by a lofted putter initially travels slightly upwards while spinning backwards, which causes the golf ball to skid or slide across the putting surface for a short distance after impact. Friction between the ball and the putting surface results in a forward moment opposing the backspin which eventually imparts a forward roll to the ball. When a golf ball is rolling forwards rather than skidding or sliding over the putting surface, the ball is less influenced by surface irregularities and the rotational inertia of the ball will cause it to have more of a tendency to continue in the true direction of the putting stroke. Thus, it is desirable to get a ball "rolling" as early after impact as possible.

Various attempts have been made to provide an improved putter that aids in imparting forward roll or topspin to a golf ball. For example, it is known to provide the front face of a putter with upwardly angled, V-shaped projections that are elongated in the direction from the heel to the toe of the putter. The sharp edges of the projections purportedly enhance friction between the putter face and the ball, creating a gripping effect as the putter comes in contact with the ball, which promotes the transfer of topspin to the ball.

There is also a demand for putters that transfer sufficient momentum to the golf ball while providing an improved "feel" for the player. The "feel" of a club generally relates to the sensory feedback that the player receives when the club head strikes the golf ball. In other words, an improved "feel" gives the player a greater sense that the putter head is an extension of the player's hands and the perception that the player is more able to guide the ball along the desired path to the hole. The feel of the putter head is primarily a function of the spring constant (k) of the putter face. The spring constant is generally determined by the Young's modulus of the material, as well as the contact area (i.e., the amount of surface area on the putter face that actually contacts the ball during the putting stroke).

When projections have been used in connection with putters, the projections unfortunately have lacked the proper structure to effectively improve the feel and control of the putter. For example, the projections typically have sharp tips, which collectively form the contact face of the putter. Because the contact area is relatively small, the ball trajectory tends to be less controllable. The lack of sufficient contact area can also result in inconsistencies between putting strokes, since the impact of the club on the ball varies significantly depending upon the location and the angle of the putter face relative to the ball. Additionally, the sharp ends of the projections increase the friction between the club face and the ball, which can result in the club conferring too much spin to the ball so that ball trajectories can be unusual and unpredictable.

To improve the feel of the putter, golf club manufacturers have designed putter heads with soft plastic inserts that are mounted on the face of the putter head. The plastic inserts are mainly directed toward improving the feel of the putter through the use of low modulus material. The plastic inserts generally have a low Young's modulus to improve the feel of the putter, but unfortunately also present certain disadvantages. In particular, plastic inserts have a tendency to lower the sound when the club impacts the ball which causes a lack of acoustic feedback to the player. Additionally, such inserts do not promote the transfer of topspin to the ball to improve control.

Accordingly, there is a need for a golf putter that promotes the transfer of topspin to the ball to improve accuracy while providing improved feel.

SUMMARY

Described below are embodiments of a putter-type golf club head and associated methods in accordance with the invention that tend to increase the consistency and accuracy of ball motion.

According to one aspect of the present invention, a golf club head is provided having a club body including a front portion, a rear portion, a toe portion, and a heel portion forming a two-piece construction. A central portion is described as being connected with the front portion and extending primarily in an XY-plane toward the rear portion. A rim is disclosed having a peripheral contour and being connected with the central portion in at least two locations. Furthermore, a substantial portion of the central portion is contained within the rim across the XY-plane.

According to another aspect of the present invention, a club body is described including a front portion, a rear portion, a toe portion, and a heel portion forming a two-piece construction. In addition, a central portion is disclosed connected with the front portion. The central portion is comprised of aluminum and has a central portion weight ratio of about 0.20-0.50. A frame is described enclosing a substantial portion of the central portion within an XY-plane and the central portion is connected with the frame.

According to another aspect of the present invention, a club body including a front portion, a rear portion, a toe portion, and a heel portion is described. A central portion is connected with the front portion. A frame is connected with the central portion and is configured to provide at least one gap between the central portion and the frame. The gap is a circular shape configured to represent a ball contour or outline, and a cup alignment indicia is located near the gap. The cup alignment indicia has a center point located toward the rear portion along a Y-axis.

According to another aspect of the present invention, a club body is described including a front portion, a rear portion, a toe portion, a heel portion, and a central portion. The central portion is connected with the front portion and extending primarily in an XY-plane toward the rear portion.

The club body further comprises a club body frame and a rim having a peripheral contour. A substantial portion of the central portion is contained within the rim across the XY-plane. In addition, a lightweight crown is located within the central portion and attached to the club body frame. The lightweight crown is located above an offset plane. The offset plane is located at 2 mm above a horizontal origin XY-plane when the club head is in a square lofted position at address.

In one example, the lightweight crown is comprised of an injection molded material and the lightweight crown includes a polymer material.

In another example, the lightweight crown weighs between about 5 g and about 35 g.

In yet another example, the lightweight crown includes a plate attached to a top surface of the lightweight crown.

In one example, the lightweight crown includes a recess for receiving a fastening member to attach the lightweight crown portion to the club body frame.

In another example, a plate is attached to a top surface of the lightweight crown to cover the recess.

In yet another example, the metallic plate weighs between about 3 g and about 10 g. In one example, the moment inertia of the club head about a CG x-axis is between about 1,000 $g \cdot cm^2$ and about 10,000 $g \cdot cm^2$.

In another example, the moment of inertia of the club head about a CG z-axis is between about 2,000 $g \cdot cm^2$ and about 14,000 $g \cdot cm^2$.

In yet another example, the moment of inertia of the club head about a CG y-axis is between about 1,000 $g \cdot cm^2$ and about 10,000 $g \cdot cm^2$.

In one example, the CGx location is between about-5.0 mm and about 5.0 mm, the CGy location is between about 30 mm and about 50 mm and the CGz location is between about 9 mm and about 15 mm.

In another example, the inner portion weight ratio is between about 0.15 and about 0.25.

In one example, the footprint ratio is between about 0.70 and about 0.90.

In yet another example, the total weight of the club head is between about 300 g and about 400 g.

In one example, the effective footprint is between about 8,000 $mm^2$ and about 10,000 $mm^2$.

In another example, the actual footprint is between about 6,000 $mm^2$ and about 8,500 $mm^2$.

To such ends, the present disclosure provides a putter head with a front surface having a plurality of deflectable beams or projections formed therein. The end surfaces of the beams collectively define a compliant striking face for striking a golf ball. Upon impact with the ball, the beams deflect and rebound to impart topspin on the ball, thereby resulting in earlier forward rotation of the ball after impact. Early forward rotation of the ball helps to minimize or eliminate the adverse effects of backspin induced skipping and sliding, such as the tendency of the ball to follow the grain of the putting green or to be knocked off line by other surface irregularities in the putting green.

Additionally, in particular embodiments, the beams are effective to impart a launch angle to the ball. The deflection of the beams also increases dwell time of the ball on the putter head, which improves the feel of the putter head when striking a golf ball.

In certain embodiments, the striking surface of the putter is comprised of a plurality of generally parallel, vertically spaced, deflectable beams extending horizontally across a front surface of the putter head. Each beam extends downwardly from a fixed end to a free end that can contact the ball. Upon impact with the ball, the beams deflect downwardly and inwardly, and then rebound upwardly and outwardly against the ball, thereby imparting topspin and providing an initial lift to the ball.

In one specific implementation, the beams can be formed directly in the front surface of the putter head. In another implementation, the beams are formed in an insert that is mounted to the front surface of the putter head. Desirably, the insert is mounted in a recess formed in the front surface. The insert can be permanently attached to the putter head, or alternatively, the insert can be removably attached to the putter head such that the insert may be replaced with another insert having different performance characteristics. In this manner, a golfer can select an insert that best suits the golfer's level of play or particular course conditions.

In particular embodiments, each beam has substantially parallel, opposed upper and lower surfaces and a substantially flat end surface. The end surfaces of the beams collectively define a striking face for contacting the ball. Each beam desirably has a substantially constant thickness measured between the upper and lower surfaces, although in other embodiments the beams can be tapered.

These and other features and aspects of the disclosed technology are set forth below with reference to the accompanying drawings.

BRIEF DESCRIPTION OF THE DRAWINGS

The present invention is illustrated by way of example and not limitation in the figures of the accompanying drawings in which like references indicate similar elements.

DETAILED DESCRIPTION

Figure 1A:
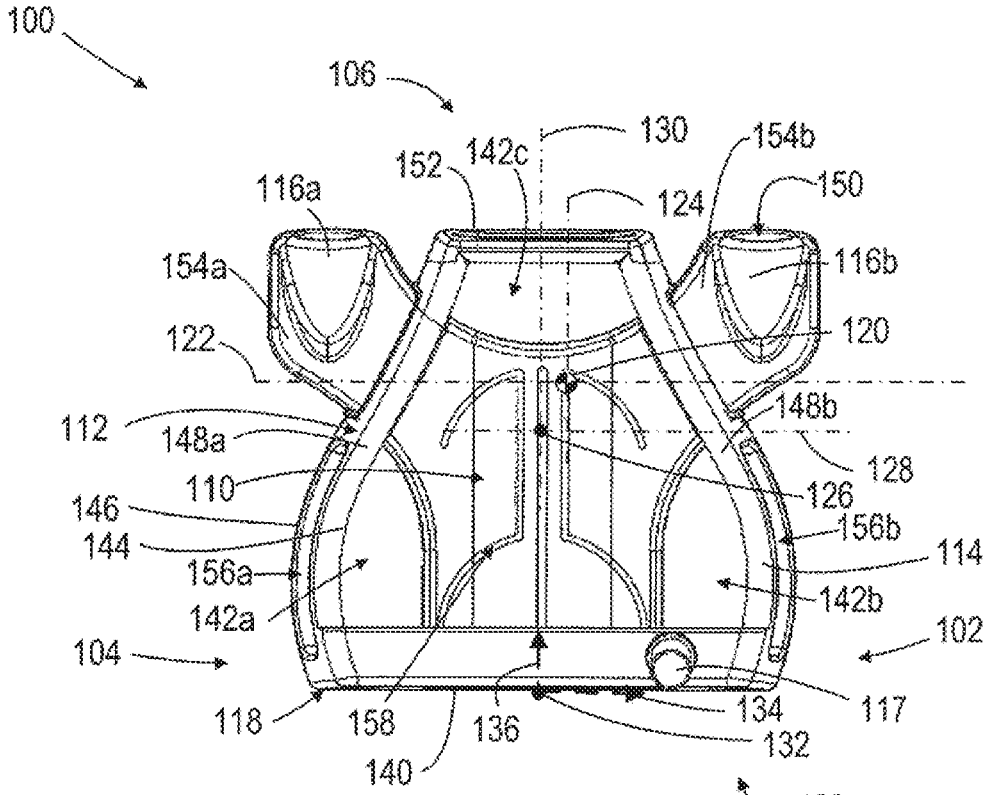
FIG. 1A is a top view of a representative golf club head, according to a first embodiment.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Certain terms will be used to address certain sections of the golf club head. For instance, the "heel" of a golf club head generally refers to the section of the golf club head that is closest to a player when the player is addressing the golf club head in a normal playing stance. The "toe" of a golf club head generally refers to the section of the golf club head that is furthest from a player when the player is addressing the golf club head in a normal playing stance. Furthermore, the "front" of the golf club head generally refers to the portion of the golf club head directly adjacent to the striking face of the club head, and the "rear" of the golf club head generally refers to the portion of the club head furthest from the striking face of the club head.

A putter-type golf club twists when striking a golf ball at an off-center portion of the putter head. As the putter head twists around a vertical axis during impact with a golf ball, the golf ball is more likely to travel in a direction other than the direction intended by the golf player. Similarly, as the putter head twists around a horizontal axis upon impact with a golf ball, the golf ball is more likely to skip over the putting green rather than roll smoothly in a straight direction.

When a golf club head twists due to an off-center hit, it twists about an axis that goes through the center of gravity (CG) of the golf club head. In general, a higher moment of inertia (MOI) decreases the amount that a golf club head will twist when a force is applied during a golf stroke. A moment of inertia about an X-axis is defined as $I_{xx}$. The $I_{xx}$ is the moment of inertia about a horizontal axis that runs from the toe to the heel of the golf club and through the CG of the club head. A large $I_{xx}$ prevents the golf club head from tilting about the horizontal X-axis during an off-center hit.

The moment of inertia about the golf club head CG X-axis is calculated by the following equation:

$$I_{CG_x} = \int (y^2 + z^2) dm$$

Furthermore, the $I_{zz}$ is the moment of inertia about the Z-axis which is a vertical axis that extends at least from the top of the golf club head to the bottom of the golf club head and through the CG of the golf club head. An increase in $I_{zz}$ decreases the amount the putter head twists with respect to the center line or path of the golf club swing during an off-center hit impacting the club face in a region closer to the heel or toe rather then the center face.

By increasing the amount of mass located in the outer sections of the putter head and moving the CG away from the front face of the putter head, the $I_{zz}$ is substantially increased. Mass arrangements according to this disclosure have provided a putter head with an $I_{zz}$ of greater than 400 kg-mm$^2$ and, in some embodiments, up to 1400 kg-mm$^2$.

A moment of inertia about the golf club head CG Z-axis is calculated by the following equation:

$$I_{CG_z} = \int (x^2 + y^2) dm$$

FIG. 1A illustrates a top view of an embodiment of a putter head 100 including a heel side 102, a toe side 104, a rear portion 106, and a front portion 108. The putter head 100 further includes a central portion 110 and a frame 112. The frame 112 includes a rim 114 having a back portion 152, a face portion 118 and a hosel 117.

In one embodiment, the club head has a general maximum width dimension (along the X-axis) of about 112 mm, a maximum length dimension (along the Y-axis) of about 94 mm, and a height dimension (along the Z-axis) of about 26 mm. It is understood that these dimensions can be varied to any value in accordance with the Rules of Golf as approved by the United States Golf Association (herein, "USGA").

FIG. 1A further shows the frame 112 enclosing a substantial portion of the central portion 110 within an X-Y plane. In other words, a majority of the central portion 110 is surrounded by the frame 112 in an X and Y direction or an X-Y plane. Two gaps 142*a*, 142*b* are located between the central portion 110 and the frame 112 in addition to a rear gap 142*c*. Specifically, a toe gap 142*a* is located on the toe side 104 while a heel gap 142*b* is located on a heel side 102 of the club head 100.

In addition, FIG. 1A shows the rim 114 having an inner peripheral contour 144 and an outer peripheral contour 146 defining a respective inner surface and outer surface. In one embodiment, the inner 144 and outer 146 peripheral contours define a pear or tear dropped shape as viewed from a top-view perspective. Furthermore, the rim 114 is shown to be extending away from the face portion 118 and defining contours 144,146 that flare outwardly from the face portion 118. In other words, two side portions 148*a*, 148*b* of the rim 114 that contact the face portion 118 initially diverge from one another toward the back portion of the club head 100. In one embodiment, the side portions 148*a*, 148*b* begin to converge toward one another at about 20 mm (or about 0.8 inches) back from a ground center point 132 along the Y-axis 136. The side portions 148*a*, 148*b* are connected with a back portion 152 that completes the peripheral contours 144,146 of the rim 114.

Furthermore, the central portion 110 includes a pair of laterally outboard weight ports, a heel-side weight port 116*b* and a toe-side weight port 116*a*, each of which contains a removable weight 150, thus there is a first weight, or heel weight, and a second weight, or toe weight, which is also true for the removable weight 250 of FIGS. 2A-2E, the removable weight 450 or FIGS. 4A-4E, and removable weights 534, 536 of FIGS. 5A-7. A user can remove the weight 150 from either weight port 116*a*, 116*b* to adjust the feel and/or trajectory of the club head. It is understood that the weight 150 can be a tungsten alloy or any metal alloy or material described herein. In addition, each weight port 116*a*, 116*b* has a thickened flange portion 154*a*, 154*b* on either side of the weight ports 116*a*, 116*b*. In one embodiment, the weight ports 116*a*, 116*b* are conical in shape where opposite sides of the conical weight ports 116*a*, 116*b* are attached to the flange portions 154*a*, 154*b*. In other words, the conical weight ports 116*a*, 116*b* are embedded in the flange portions 154*a*, 154*b* and are configured to allow the weights 150 to be inserted or attached to the weight ports 116*a*, 116*b*. The weights 150 can be threaded for engagement with the weight ports 116*a*, 116*b* and can weigh about 4 grams or more. It is understood that the weights 150 can be attached by another other known means of attachment. FIG. 1A shows the flange portions 154 and weight ports 116 extending beyond the outer peripheral contour of the rim 114. As seen best in FIG. 4B, at least a portion of the first weight and the second weight is located below the golf putter head center of gravity. Similarly, with reference to FIGS. 1A-1E, 2A-2E, 4A-4E, and 5A-7, at least a portion of the first weight is located rearward of the toe gap and the heel gap, at least a portion of the second weight is located rearward of the toe gap and the heel gap, and of the first weight is located heelward of at least a portion of the central body portion bounding the heel gap and heelward of at least a portion of a hosel.

FIG. 1A further illustrates an alignment indicia 158 including three contiguous lines located on the central portion 110 that a golfer may use to align the ball with the center of the club head 100. The three contiguous lines include a straight middle line extending from the face portion 118 toward a rear section of the central portion 110. Two contiguous lines are located on either side of the straight middle line and are each are configured to have two non-linear curved sections. When viewed by the golfer, the curved sections of the non-linear contiguous lines each create an outline of a quarter-circle. When viewed together, two laterally adjacent curved sections create the impression of a semicircular shape. The four curved sections of each non-linear contiguous line are arranged so that two semicircular shapes are defined. The first semicircular shape is located near the face portion 118 and the second semicircular shape is located away from the face portion 118 along the Y-axis 136. In one embodiment, the two semicircular shapes are approximately the same radius as a golf ball and allow the golfer to visually align the golf ball with the center of the face insert 140 and club head 100 for a more consistent putt.

The putter head 100 further includes a CG 120 having a CG X-axis 122, a CG Z-axis 123, and a CG Y-axis 124. The CG Y-axis 124 extends along the length of the putter from a rear to front direction and passes through the CG 120. In addition, the CG X-axis extends along the width of the putter head from a heel to toe direction and passes through the CG 120. The CG Z-axis extends in a vertical direction along the height of the putter head 100 between a bottom and top portion. As shown in FIG. 1A, the CG 120 is located to the rear of the geometric center point 126 having a horizontal dashed center X-axis 128 separating the front portion 108 from the rear portion 106. The geometric center point 126 also defines a vertical dashed center Y-axis 130 separating the heel side 102 from the toe side 104. It is understood that the CG 120 location can coincide with the geometric center point 126 or can be located away from the geometric center point 126.

Figure 1B:
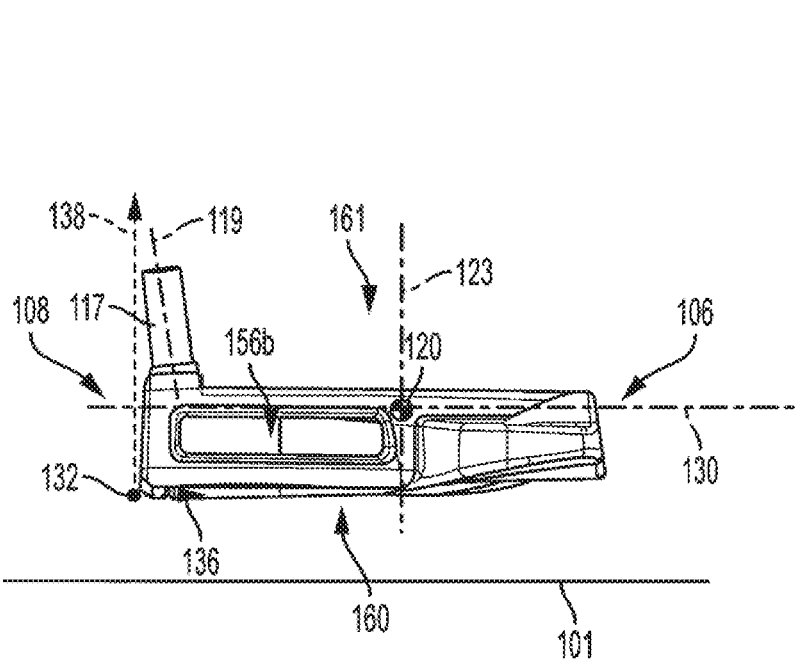
FIG. 1B is an elevated side view of the golf club head of FIG. 1A.

Furthermore, FIGS. 1A and 1B show a ground center location 132 (located near a bottom edge of the face) having a ground center X-axis 134, a ground center Y-axis 136, and ground center Z-axis 138. The ground center location 132 is located at the center of the width of the putter face insert 140 and at the intersection of the face portion 118 plane (a plane containing the face) and a sole portion 160 plane (a horizontal ground plane tangent to the lowest point of the club head). The CG 120 location of the putter head 100 is measured from the ground center location 132. In one embodiment, the CG location includes a CGx of about 0.7 mm (toward the hosel), a CGy of about 40.2 mm and a CGz of about 13.4 mm.

In one embodiment, the club head 100 has an $I_{xx}$ value of about 3868 g·cm$^2$, an $I_{yy}$ value of about 3387 g·cm$^2$, and an $I_{zz}$ value of about 6782 g·cm$^2$. The unique construction and configuration of the described elements described herein enable the above moment of inertia values to be achieved. A large CGy value will promote more forward roll or spin upon impact with the golf ball. In addition, a higher moment of inertia will produce less twisting of the club head upon impact.

In certain embodiments, the central portion 110 is comprised of an aluminum hollow body having a mass of about 108 g. In addition, the frame 112 is a steel frame having a mass of about 205 g. Upon assembly, the entire mass of the club head including gaskets and weights 150 is about 357.3 g. The "two-piece" construction of an aluminum central portion 110 and a steel frame 112 permit a more rearward CG location and higher moment inertia to be achieved.

In one preferred embodiment, about 77% (footprint about 3,918 mm$^2$) of the central portion 110 is enclosed by the frame 112 while about 32% (footprint about 1,820 mm$^2$) of the central portion 110 is located outside of the frame 112 across an X-Y plane. In other embodiments, about 55-95% of the central portion is contained within the peripheral contours of the rim 114 across an X-Y plane. In one embodiment, the footprint of the central portion 110 is about 5,738 mm$^2$.

The weight distribution of the embodiment shown in FIGS. 1A-1E can provide about 40% of the total weight behind the projected width of a ball located at an ideal ball impact location along the Y-axis 136 and about 30% on each of the toe 104 and heel 102 portions. The toe 104 and heel 102 portions are defined as regions of the putter 100 that are not directly located behind the ball at an ideal impact location.

Table 1, as shown below provides various examples of putter head configurations and the related footprint values. The "footprint" is defined as the projected area occupied by the putter head on an X-Y plane. The "Effective Footprint" is defined as the area occupied by the outermost silhouette of the entire putter projected onto an X-Y plane. The "Actual Footprint" is defined as the area occupied by the actual silhouette of the entire putter projected onto an X-Y plane. The "Actual Footprint" excludes any gap areas between a central portion and frame portion. The "Footprint Ratio" is defined as the Actual Footprint divided by the Effective Footprint. The "SS Width" is the striking surface width upon which the ball can contact. The CPWR is defined as the Central Portion Weight Ratio which is a ratio between the central portion and the total weight of the putter head (when the putter head is fully assembled including the central portion). Providing a low CPWR allows the CG location to be desirably positioned. The central portion is defined as any portion located primarily within the frame inner peripheral edge that is not co-formed or co-cast with the rim portion. The central portion can extend between the sole and crown portion of the putter or can be a removably detachable crown portion.

The IPWR is defined as the Inner Portion Weight Ratio which is a ratio between the inner portion of the central portion (located within the frame inner peripheral edge) and the total weight of the putter head (when the putter head is fully assembled). The weight of the inner portion of the central portion located within the inner peripheral edge is divided by the total weight of the putter head. The IPWR highlights the light center portion of the putters described in some of the embodiments.

TABLE 1

| | SS Width (mm) | Effective Footprint (mm$^2$) | Actual Footprint (mm$^2$) | Footprint Ratio | CPWR | IPWR |
|---|---|---|---|---|---|---|
| Example 1 | 86-92 | 9473 | 7906 | 0.83 | 0.30 | 0.24 |
| Example 2 | 76-86 | 7440 | 6467 | 0.87 | 0.22 | 0.17 |
| Example 3 | 86-94 | 9307 | 7067 | 0.76 | — | — |
| Example 4 | 76-96 | 8447 | 6982 | 0.83 | 0.05 | 0.24 |

In certain embodiments, the footprint ratio ranges from 0.70 to 0.90, while maintaining the CG and moment of inertia values described herein. In further embodiments, the CPWR is from 0.20 to 0.50. In one example, the embodiment shown in FIGS. 1A-1E can have the footprint values and striking surface width of Example 1 shown in Table 1. In one embodiment, the weight of the central portion 110 inside the inner peripheral edge of the frame is about 89 g (used to calculate the IPWR). In some embodiments, the IPWR is less than about 0.25 or between about 0.15 and 0.25 as shown in the examples above. Also shown in Table 1, the Effective Footprint can range between about 8,000 mm$^2$ and about 10,000 mm$^2$ while the Actual Footprint can range between about 6,000 mm$^2$ and about 8, 500 mm$^2$.

FIG. 1B further shows a hosel axis 119 extending along the axis of the hosel 117. In one embodiment, the hosel axis creates a hosel axis angle of about 83° with respect to a ground surface 101 within a Y-Z plane. Moreover, the side portions 148*a*, 148*b* include a slotted region 156*a*, 156*b* creating a through hole or through slot on each side portion 148*a*, 148*b*. In addition, FIG. 1B also shows a back portion 106 having a portion of the sole 160 that is angled away from a ground surface 101 and tapers toward the top portion 161. As seen in FIGS. 1D, 2D, and 4D, the toe side portion 148*a* may comprises a first toe side portion 148*al* extending rearwardly from the face portion toe side and flaring outwardly from the striking surface 118 thereby diverging from the ground center Y-axis 136, and a second toe side portion 148*a*2 extending rearwardly from the first toe side portion 148*al* toward the back portion. Likewise, the heel side portion 148*b* may comprises a first heel side portion 148*b*1 extending rearwardly from the face portion heel side and flaring outwardly from the striking surface 118 thereby diverging from the ground center Y-axis 136 and a second heel side portion 148*b*2 extending rearwardly from the first heel side portion 148*b*1 toward the back portion. The second toe side portion 148*a*2 and the second heel side portion 148*b*2 converge toward one another, and thus toward the ground center Y-axis 136.

Figure 1C:
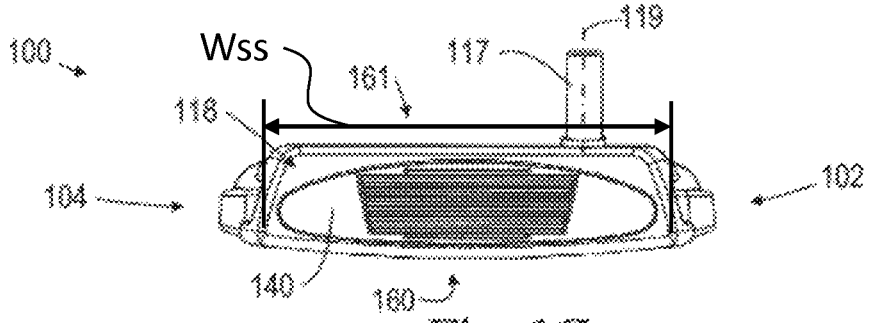
FIG. 1C is an elevated front view of the golf club head of FIG. 1A.
Figure 1D:
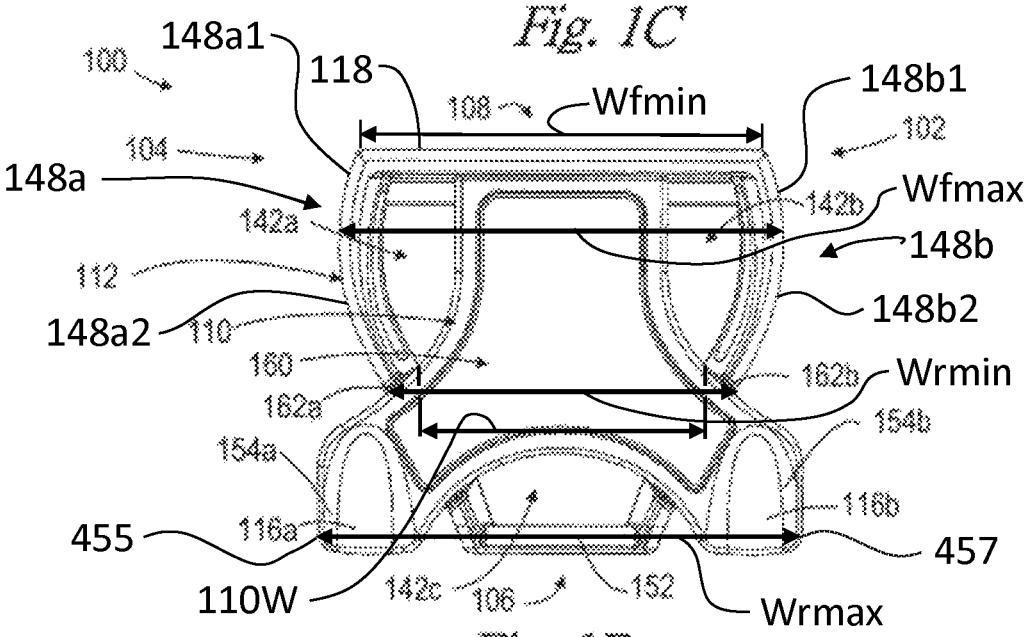
FIG. 1D is a bottom perspective view of the golf club head of FIG. 1A.

FIG. 1C further shows a face insert 140 that is included in the face portion 118. In one embodiment, a hosel lie angle of about 70° is provided within an X-Z plane. Located underneath the face insert 140 on a face insert mounting surface are two countersink or counterbore holes configured to receive two fastening mechanisms to secure a front portion of the central portion 110 to the frame 112 (as shown in other embodiments described herein). The face insert can include grooves for promoting forward roll as described in U.S. Pat. Nos. 7,278,926 and 7,465,240 which are incorporated by reference in their entirety. The face insert 140 can also be made of various materials, such as aluminum or a polymer material, as described in further detail below.

Referring first to FIGS. 8-11, there is shown a putter head 1010, according to one embodiment, which is used to putt a ball (not shown) toward a hole (not shown). The putter head 1010 generally comprises an elongated main body 1012 having an upwardly extending neck 1014. The neck 1014 allows the putter head 1010 to be connected to a golf club shaft (not shown) in a conventional manner.

Figure 18:
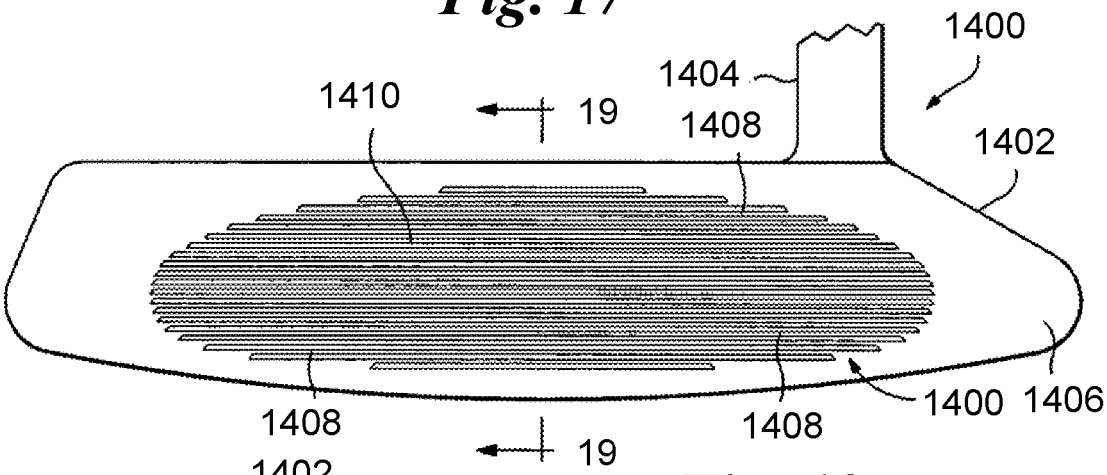
FIG. 18 is a front elevation view of a putter head having a plurality of beams formed directly in the front surface of the putter head, according to one embodiment.
Figure 19:
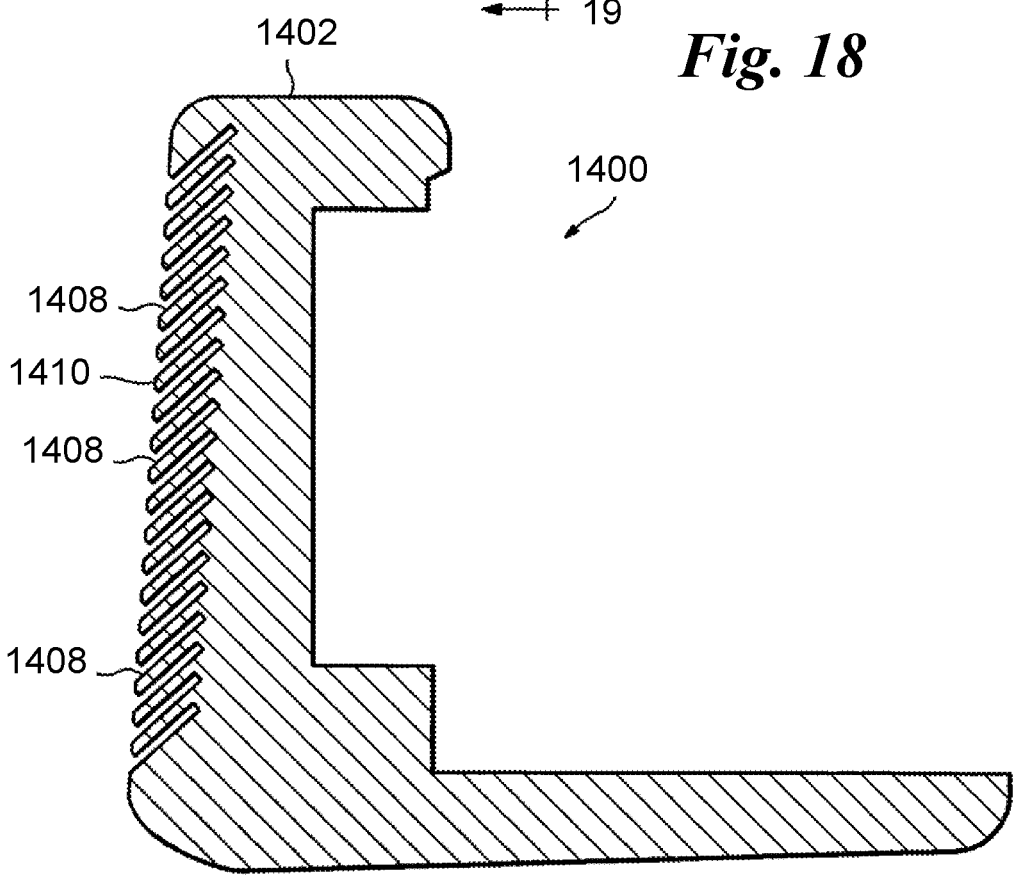
FIG. 19 is cross-sectional view of the putter head of FIG. 18 taken along line 19-19 of FIG. 18.

The main body 1012 in the illustrated configuration has a front surface 1016 that defines a heel 1020, a toe 1022, a top edge 1024, and a bottom edge 1026. An insert 1018 desirably is sized and shaped to fit within a recess 1050 (FIG. 9) in the front surface 1016. The illustrated insert 1018 comprises a plate-like structure defining a plurality of generally parallel, vertically spaced, deflectable beams, or projections, 1028 extending horizontally across the front surface 1016 between the heel 1020 and the toe 1022. The end surfaces 1030 of the beams 1028 collectively define a compliant striking face 1048 for contacting the ball. In an alternative embodiment, the beams 1028 can be formed directly in the main body 1012 (such as shown in FIGS. 18 and 19), rather than in the insert 1018. Upon impact with the ball, the beams 1028 deflect and rebound to impart topspin and provide an initial lift to the ball, as further described below.

The insert 1018 desirably is sized such that the end surfaces 1030 of the beams 1028 are substantially flush with and parallel to a peripheral portion 1032 of the front surface 1016 surrounding the insert 1018. In alternative embodiments, however, the beams 1028 can be raised with respect to the peripheral portion 1032, or alternatively, the beams 1028 can be recessed inwardly from the peripheral portion 1032. The insert 1018 can be attached to the main body 1012 using any suitable techniques or mechanisms, such as mechanical bonding, adhesive bonding, welding, brazing, mechanical fasteners, etc.

Alternatively, the insert 1018 can be removably mounted to the main body 1012, such as with screws or via a frictional fit between the insert 1018 and the surrounding recess. Thus, in this alternative embodiment, the putter can be adapted to accept different inserts for different golfers and/or different course conditions.

Figures 10, 11, 13, 14, 15:
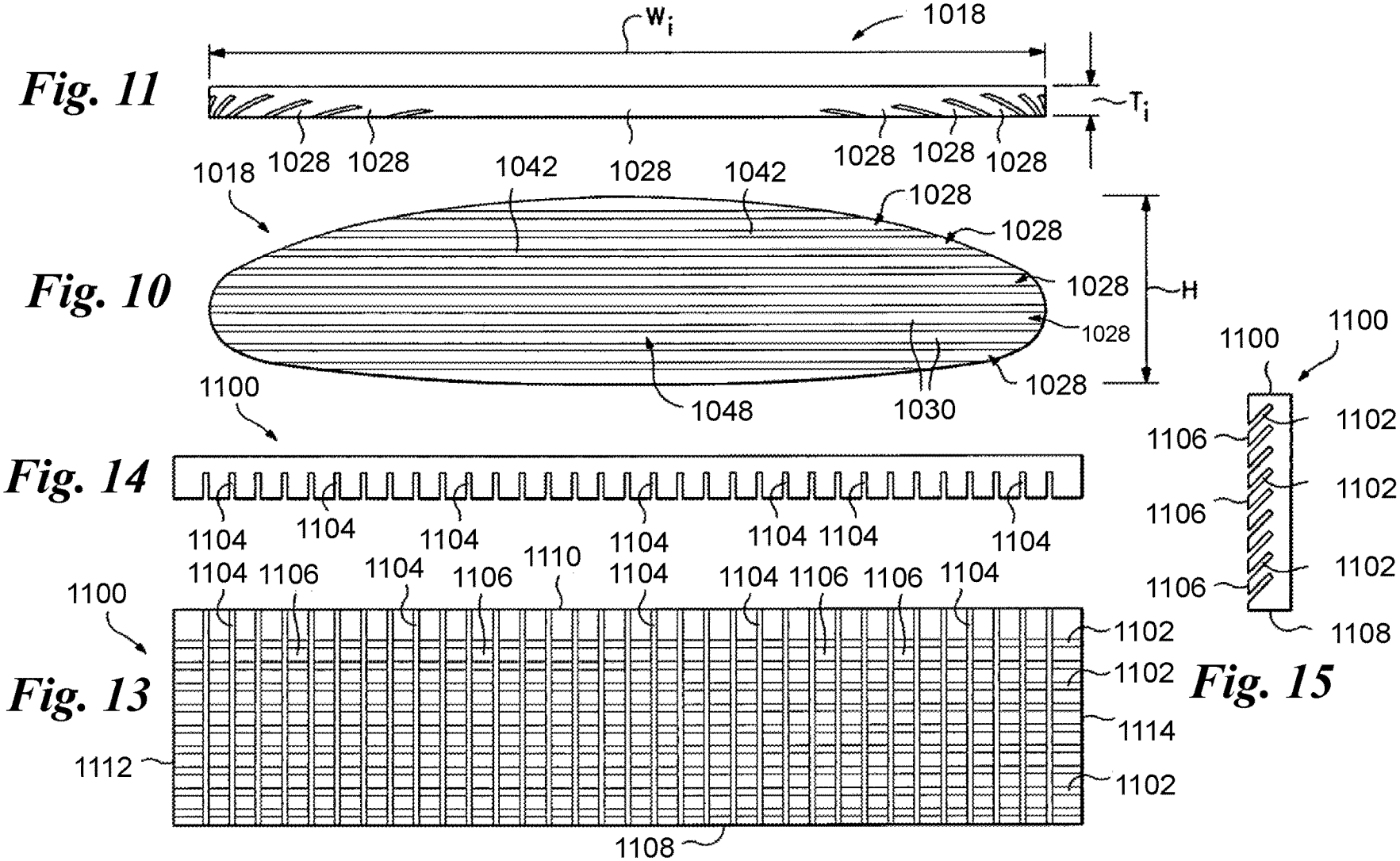
FIG. 10 is a front elevation view of the insert of FIG. 8, shown removed from the putter head.
FIG. 11 is a plan view showing the top edge of the insert shown in FIG. 10.
FIG. 13 is a front elevation view of an insert that can be mounted to the front surface of a putter head, according to another embodiment.
FIG. 14 is a plan view showing the top edge of the insert shown in FIG. 13.
FIG. 15 is an elevation view showing the side edge of the insert shown in FIG. 13.

The insert 1018 desirably has a shape that conforms to the desired general strike location of a ball with the front surface 1016 of the putter head 1010. In the illustrated embodiment, the insert 1018 is generally elliptical, but can also comprise any other geometric shape, such as a rectangle (as shown in FIG. 13), square, circle, trapezoid, or combinations thereof. Also, although the peripheral portion 1032 of the front surface 1016 is shown as completely surrounding the insert 1018, this is not a requirement. For example, in one embodiment, the insert 1018 can extend from the top edge 1024 to the bottom edge 1026 of the front surface 1016. In another embodiment, the insert can extend from the heel 1020 to the toe 1022 across the entire width of the front surface 1016.

The insert 1018 and the main body 1012 may be formed either from a metal/metal alloy, polymer, composite, ceramic, or various combinations thereof. Generally, an insert 1018 formed from a metallic material provides the putter head 1010 with a more solid feel during impact with a golf ball, whereas an insert 1018 formed from a polymeric material, such as plastic, provides a softer feel than a metallic insert. The insert 1018 may be manufactured of the same material as the main body 1012 or it may be manufactured of a different material.

Some examples of metals and metal alloys that can be used to form the insert 1018 or the main body 1012 include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

Some examples of composites that can be used to form the insert 1018 or the main body 1012 include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the insert 1018 or the main body 1012 include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®).

Some examples of ceramics that can be used to form the insert 1018 or the main body 1012 include, without limitation, oxides (e.g., titanium oxide, aluminum oxide, magnesium oxide, and silicon oxide), carbides (e.g., titanium carbide, tungsten carbide, silicon carbide, and boron carbide), and nitrides (e.g., silicon nitride).

The insert 1018 can be formed using conventional manufacturing techniques, such as, for example, die casting, injection molding, extrusion, forging, saw cutting, EDM (electrical discharge machining), milling, etching, etc. Any of the foregoing manufacturing techniques also can be used if the beams are formed directly in the front face 1016 of the main body 1012, rather than in an insert. The insert 1018 and/or the main body 1012 can be subjected to various surface treatment and/or coating processes, such as, for example, anodizing, nitriding, ion plating, PVD (physical vapor deposition), CVD (chemical vapor deposition), painting, powdercoating, electroplating, electroless plating, etc. to improve corrosion resistance, abrasion resistance, hardness, or other characteristics of the components.

Figure 12:
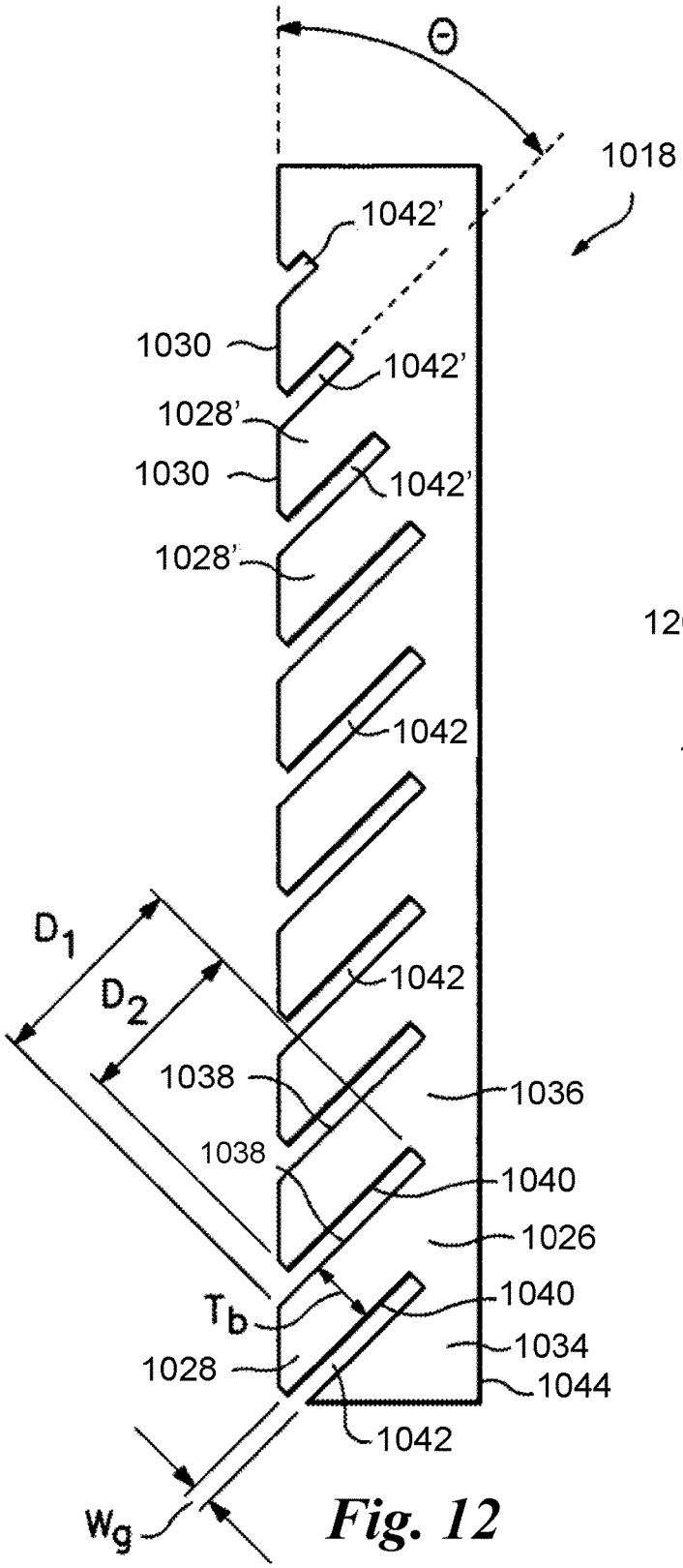
FIG. 12 is an enlarged, elevation view showing the side edge of the insert shown in FIG. 10.

As best shown in FIG. 12, the beams 1028 extend outwardly and downwardly from a base 1034 of the insert 1018. The end surfaces 1030 of the beams 1028 desirably are flat and co-planar with the peripheral portion 1032 of the front surface 1016. Each beam 1028 has a fixed end 1036 that is desirably integrally formed with the base 1034. Each beam 1028 in the illustrated configuration has a cross-sectional profile generally in the form of a parallelogram. Each beam 1028 has an upper surface 1038 spaced from a substantially parallel lower surface 1040 defining a substantially constant beam thickness Tb measured between the upper and lower surfaces 1038, 1040. The beams 1028 can extend continuously between opposing points on the periphery of the insert 1018, as shown in FIG. 10. In alternative embodiments, however, the insert 1018 can be formed with one or more rows of horizontally spaced beams (e.g., beams 1106 shown in FIGS. 13-15).

The upper surface 1038 has a depth D1 that preferably is slightly greater than the depth D2 of the lower surface 1040. A gap 1042 is defined between the upper and lower surfaces 1038, 1040 of adjacent beams 1028. Each gap 1042 defines a substantially constant gap width Wg measured between the upper and lower surfaces 1038, 1040 of adjacent beams 1028. The depths D1 and D2 for each beam 1028 in the illustrated embodiment are the same, except for the top three beams 1028', which have depths that decrease progressively in the upward direction. This provides greater rigidity to the top three beams 1028'. In some embodiments, the gap width Wg of one or more gaps 1042 may be varied depending on the orientation of the gaps 1042 with respect to the center of the insert 1018. For example, a gap 1042 disposed at the center of the insert 1018 may have a larger gap width Wg than a gap 1042 disposed towards the top and/or bottom of the insert 1018.

In certain embodiments, one or more gaps 1042 between adjacent beams 1028 may extend to the rear surface 1044 of insert 1018, thereby forming one or more vertically spaced slots extending through the entire thickness $T_1$ of the insert 1018. Such slots may extend across all or a portion of the width Wi of the insert 1018 and provide a maximum beam depth D1 and/or D2 for a particular insert thickness.

In certain embodiments, the beam upper surfaces 1038 have a depth D1 that is between approximately 1 and 3 mm; the beam lower surfaces 1040 have a depth D2 that is between approximately 0.8 and 2.8 mm; the beams 1028 have a thickness Tb that is between approximately 0.3 and 1.0 mm; and the gaps 1042 have a gap width Wg that is between approximately 0.1 and 0.4 mm. Of course, these specific dimensions (as well as other dimensions provided in the present specification) are given to illustrate the invention and not to limit it. The dimensions provided herein can be modified as needed in different applications or situations.

As shown in FIG. 10, the gaps 1042 between adjacent beams 1028 can extend across the entire width Wi of the insert 1018. In an alternative embodiment, the gaps 1042 between adjacent beams 1028 can extend less than the entire width Wi of the insert 1018, such that one or both toe/heel end portions of the beams 1028 are fixed relative to a peripheral portion of the insert (such as insert 1300 shown in FIG. 17 and further described below).

The insert 1018 in the illustrated embodiment has nine beams 1028, although in other embodiments the insert 1018 can have greater or fewer number of beams 1028. In certain embodiments, for example, the insert 1018 can have eight to fifteen beams.

As shown in FIG. 12, when the putter head 1010 is at address position, beams 1028 project downwards toward a bottom portion of the main body 1012 (FIG. 8) such that beams 1028 define an acute angle θ extending between the beams 1028 and a vertical axis (relative to a putting surface ground plane). In one embodiment, angle θ may be defined as the angle extending between an upper surface 1038 of a beam 1028 and a vertical axis. In an alternative embodiment, angle θ may be defined as the angle extending between a lower surface 1040 of a beam 1028 and a vertical axis.

In particular embodiments, the sum of angle θ and the loft angle of the putter is in the range of about 10 to 80 degrees, and more desirably about 30 to 60 degrees, and most desirably about 40 to 50 degrees, with 45 degrees being a specific example. In typical embodiments where the putter loft angle ranges from 3 to 5 degrees, angle θ is in the range of about 6 to 76 degrees, and more desirably about 26 to 56 degrees, and most desirably about 36 to 46 degrees, with 41 degrees being a specific example.

In an alternative embodiment where the insert rear surface 1044 is substantially parallel to a striking face 1048 collectively defined by the end surfaces 1030 of the beams 1028, each beam may define an acute angle extending between a beam and the rear surface 1044 of the insert 1018. In such an embodiment, the acute angle may be of the same magnitude as angle θ as defined above.

Upon contact with a ball, the beams 1028 deflect inwardly and downwardly, and then recoil outwardly and upwardly, thereby imparting topspin and a launch angle to the ball. The frequency of oscillation (f) of a beam 1028 can be estimated by the following equation:

$$f = \sqrt{\frac{E \cdot T_b^2 \cdot \lambda^4}{48 \cdot \pi^2 \cdot \rho \cdot D_2^4}}$$

where E is the Young's modulus of the beam material, λ is equal to 1.8751 for the fundamental mode of vibration, and p is the density of the beam material. In certain embodiments, the beams 1028 have a frequency of oscillation in the range of about 3 kHz to about 300 kHz, and more desirably in the range of about 8 kHz to about 150 kHz, and most desirably in the range of about 12 kHz to about 95 kHz.

The beams 1028 in certain embodiments are sufficiently resilient to deflect upon impact, but yet are stiff enough to be self-supporting; that is, the stiffness of the beams prevent a beam from contacting an adjacent beam upon deflection. In other embodiments, however, the beams 1028 can be configured to contact each other upon deflection.

Additionally, the dimensions of the beams 1028 can be varied to achieve different performance characteristics for different levels of play or different course conditions. For example, the effective spring constant of the beams 1028 (i.e., the stiffness of the beams) can be decreased to increase the amount of forward roll imparted on the ball by increasing the depth of the beams, decreasing the beam thickness, and/or forming the beams 1028 from a material having a lower modulus of elasticity.

In alternative embodiments, the cross-sectional profile of the beams 1028 can define any of various geometric shapes. In one implementation, for example, the beams 1028 can be tapered from their fixed ends 1036 to their end surfaces 1030. Alternatively, the beams 1028 can be tapered from their end surfaces 1030 to their fixed ends 1036. Rather than having flat end surfaces 1030, the beams 1028 can have a generally V-shaped cross-sectional profile such that the beams 1028 taper to a sharp outer edge for contacting the ball. In still another implementation, the beams 28 can have curved end surfaces for contacting the ball.

The thickness Tb of one or more beams 1028 can vary across the width of the beams. For example, the thickness Tb of a beam 1028 can be greatest at the heel 1020 and toe 1022 ends of the insert 1018 and decrease moving toward the center, or alternatively, the thickness Tb of a beam 1028 can be greatest at the center of the insert 1018 and decrease moving toward the heel 1020 and toe 1022 ends of the insert 1018. Also, the thickness Tb of one or more beams 1028 can vary across the height H of the insert 1018. For example, the thickness Tb of beams 1028 disposed at either or both of the top and bottom of the insert 1018 may be greater than the thickness Tb of beams 1028 disposed at the center of the insert 1018. Conversely, the thickness Tb of beams 1028 disposed at the center of the insert 1018 may be greater than the thickness Tb of beams 1028 disposed at either or both of the top and bottom of the insert 1018.

In alternative embodiments, the end surfaces 1030 of the beams 1028 and/or the peripheral portion 1032 of the front surface 1016 can have various surface textures for aesthetics, to increase the coefficient of friction of the striking face, or for other reasons. For example, a series of straight or arcuate parallel grooves can be formed in the end surfaces 1030 and the peripheral portion 1032.

In particular embodiments, the gaps 1042 between the beams 1028 can be filled with a compliant filler material to prevent debris, such as grass or dirt, from collecting in the gaps. The filler material desirably is compliant enough to allow for sufficient deflection of the beams.

Examples of suitable filler materials that can be used include, without limitation, viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available filler materials include resilient polymeric materials such as Scotchdamp™ from 3M, Sorbothane® from Sorbothane, Inc., DYAD® and GP® from Soundcoat Company Inc., Dynamat® from Dynamat Control of North America, Inc., No ViFlex™ Sylomer® from Pole Star Maritime Group, LLC, Isoplast® from The Dow Chemical Company, and Legetolex™ from Piqua Technologies, Inc.

Another group of suitable filler materials is low-density granular materials such as, without limitation, perlite; vermiculite; polyethylene beads; glass microspheres; expanded polystyrene; nylon flock; ceramics; polymeric elastomers; rubbers; dendritic particles; and mixtures thereof.

The putter head 1010 is used to propel a golf ball toward a hole by striking the golf ball with the striking face 1048 that is collectively formed by the end surfaces 1030 of the beams 1028. Desirably, the golfer aligns the putter head 1010 such that the end surfaces 1030 of the beams 1028 are the only portion of the putter head 1010 to contact the ball during the putting stroke. Upon impact with a ball, the beams 1028 deflect downwardly and inwardly and then rebound upwardly and outwardly, thereby pushing on the ball periphery in the same direction. The rebound of the beams 1028 applies a forward moment on the ball so as to cause forward rotation of the ball immediately or shortly after impact with the striking face 48. The early forward rotation of the ball helps to minimize or eliminate the adverse effects of backspin induced skipping and sliding, such as the tendency of the ball to follow the grain of the putting green or to be knocked off line by other surface irregularities in the putting green. Moreover, because the beams 1028 deflect and rebound in a predictable fashion, the beams 1028 improve the feel of the putter head 1010 when striking a golf ball. Also, unlike typical conventional putter heads having projections to improve the feel of the putter head, control of the golf ball is not adversely affected. As discussed above, control of the ball actually is improved due the tendency of the beams to impart topspin and a launch angle to the ball.

FIGS. 13-15 show an insert 1100 for a putter head, according to another embodiment. The insert 1100 is generally rectangular, although it can have other geometric shapes. The insert 1100 can be attached to a putter head, such as by mounting the insert in a recessed portion in the front face of the putter head, as described above. The insert 1100 is formed with a plurality of horizontally extending, vertically spaced gaps, or cuts, 1102 and a plurality of vertically extending, horizontally spaced gaps, or cuts, 1104, which form a plurality of downwardly extending beams, or projections, 1106.

While the horizontal gaps 1102 are spaced uniformly moving from the bottom edge 1108 to the top edge 1110 of the insert 1100 and the vertical gaps 1102 are spaced uniformly moving from the toe edge 1112 (the left edge in FIG. 13) to the heel edge 1114 (the right edge in FIG. 13), this is not a requirement. Accordingly, the spacing of the horizontal gaps 1102 and/or the vertical gaps 1104 can be varied across the face of the insert 1100, so as to achieve different beam stiffness at different sections of the insert 1100. In addition, the insert 1100 can be formed with vertical gaps 1104 that extend only partially between the top and bottom edges 1110, 1108 of the insert.

Figure 16:
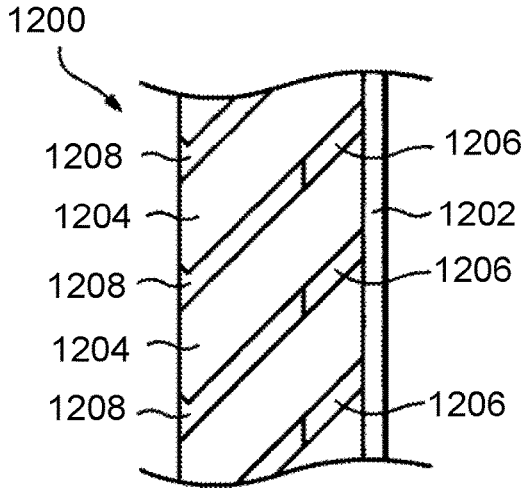
FIG. 16 is an enlarged, partial side elevation view of an insert, according to another embodiment.

FIG. 16 shows an insert 1200, according to another embodiment. The illustrated insert 1200 comprises a support 1202 that can comprise a plate-like member and a plurality of beams 1204 extending downwardly from the support 1202. In particular embodiments, the beams 1204 are separately formed and subsequently attached to the support 1202 using suitable techniques or mechanisms, such as mechanical bonding, adhesive bonding, welding, brazing, mechanical fasteners, etc.

As shown, spacers 1206 can be positioned between adjacent beams 1204. The depth of the spacers 1206 can be varied to alter the effective depth of the beams 1204 (i.e., the portion of a beam 1204 that is cantilevered with respect to an adjacent spacer 1206). For example, increasing the depth of the spacers 1206 decreases the effective depth of the beams 1204 and therefore increases the stiffness of the beams. Similarly, the thickness of the spacers 1206 can be varied to alter the gap width between adjacent beams 1204. For example, increasing the thickness of the spacers 1206 increases the gap width between adjacent beams 1204. The support 1202, the beams 1204, and the spacers 1206 can be made of any of various suitable materials, such as any of the metals, metal alloys, composites, polymers, or ceramics described above for the insert 1018.

Additionally, the insert 1200 can include optional compliant filler material 1208 disposed between adjacent beams 1204 to prevent debris from collecting in the gaps between adjacent beams. The filler material 1208 can comprise any of the suitable filler materials described above for the insert 1018.

Figure 17:
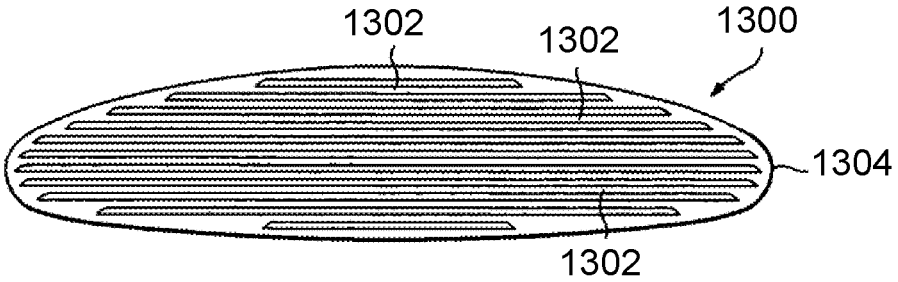
FIG. 17 is a front elevation view of another embodiment of an insert.

FIG. 17 shows an insert 1300, according to yet another embodiment, that includes a plurality of beams 1302. The insert 1300 is similar to the insert 1018 shown in FIGS. 8-12, with the exception that the beams 1302 of the insert 1300 do not extend across the entire width Wi of the insert 1300 and instead terminate at a peripheral portion 1304 that surrounds the beams 1302. In a modification of the insert 1300, the peripheral portion 1304 extends only partially around the beams 1302.

FIGS. 18 and 19 show a putter head 1400, according to another embodiment, that comprises a main body 1402 having an upwardly extending neck 1404. Unlike the putter head 1010 shown in FIGS. 8 and 9, the putter head 1400 includes a plurality of beams 1408 formed directly in the front surface 1406 of the main body 1402. The end surfaces of the beams 1408 collectively define a striking face 1410 for contacting a ball. The overall shape of striking face 1410 in the illustrated embodiment is similar to the shape of the insert 1018 shown in FIGS. 8-12. However, this is not a requirement. Accordingly, the striking face 1410 can have any of various shapes and can cover any portion of the front surface 1406. Similarly, the beams 1408 can have any of the various shapes or configurations described above for the beams 1028.

EXAMPLES

Example 1

An insert 1018 was constructed of ABS plastic with an overall width Wi (FIG. 11), height H (FIG. 10), and thickness Ti (FIG. 11) of about 85.16 mm, 18.59 mm, and 3.05 mm, respectively. The insert included ten beams 1028. The beams had a depth D1 of about 3.10 mm, a depth D2 of about 2.62 mm, a thickness Tb of about 0.89 mm, a gap width Wg of about 0.30 mm, and were oriented at approximately a 45 degree angle with respect to a vertical axis relative to a putting surface ground plane.

Example 2

An insert 1018 was constructed of 6061 anodized aluminum with an overall width Wi (FIG. 11), height H (FIG. 10), and thickness Ti (FIG. 11) of about 85.16 mm, 18.59 mm, and 3.05 mm, respectively. The insert included fifteen beams 1028. The beams had a depth D1 of about 3.10 mm, a depth D2 of about 2.62 mm, a thickness Tb of about 0.40 mm, a gap width Wg of about 0.30 mm, and were oriented at approximately a 45 degree angle with respect to a vertical axis relative to a putting surface ground plane.

Example 3

An insert 1018 was constructed of 6061 anodized aluminum with an overall width Wi (FIG. 11), height H (FIG. 10), and thickness Ti (FIG. 11) of about 85.16 mm, 18.59 mm, and 3.05 mm, respectively. The insert included twelve beams 1028. The beams 1028 had a depth D1 of about 3.10 mm, a depth D2 of about 2.62 mm, a thickness Tb of about 0.68 mm, a gap width Wg of about 0.30 mm, and were oriented at approximately a 45 degree angle with respect to a vertical axis relative to a putting surface ground plane.

Example 4

An insert 1018 was constructed of 6061 anodized aluminum with an overall width Wi (FIG. 11), height H (FIG. 10), and thickness Ti (FIG. 11) of about 85.16 mm, 18.59 mm, and 3.05 mm, respectively. The insert included eleven beams 1028. The beams 1028 had a depth D1 of about 3.10 mm, a depth D2 of about 2.62 mm, a thickness Tb of about 0.78 mm, a gap width Wg of about 0.30 mm, and were oriented at approximately a 45 degree angle with respect to a vertical axis relative to a putting surface ground plane.

Example 5

An insert 1018 was constructed of 6061 anodized aluminum with an overall width Wi (FIG. 11), height H (FIG. 10), and thickness Ti (FIG. 11) of about 85.16 mm, 18.59 mm, and 3.05 mm, respectively. The insert included ten beams 1028. The beams had a depth D1 of about 3.10 mm, a depth D2 of about 2.62 mm, a thickness Tb of about 0.89 mm, a gap width Wg of about 0.30 mm, and were oriented at approximately a 45 degree angle with respect to a vertical axis relative to a putting surface ground plane.

Example 6

An insert 1018 was constructed of 6061 anodized aluminum with an overall width Wi (FIG. 11), height H (FIG. 10), and thickness Ti (FIG. 11) of about 85.16 mm, 18.59 mm, and 3.05 mm, respectively. The insert included nine beams 1028. The beams 1028 had a depth D1 of about 3.10 mm, a depth D2 of about 2.62 mm, a thickness Tb of about 1.03 mm, a gap width Wg of about 0.30 mm, and were oriented at approximately a 45 degree angle with respect to a vertical axis relative to a putting surface ground plane.

Example 7

An insert 1018 was constructed of 6061 anodized aluminum with an overall width Wi (FIG. 11), height H (FIG. 10), and thickness Ti (FIG. 11) of about 85.16 mm, 18.59 mm, and 3.05 mm, respectively. The insert included eight beams 1028. The beams 1028 had a depth D1 of about 3.10 mm, a depth D2 of about 2.62 mm, a thickness Tb of about 1.18 mm, a gap width Wg of about 0.30 mm, and were oriented at approximately a 45 degree angle with respect to a vertical axis relative to a putting surface ground plane.

Example 8

An insert 1100 was constructed of 6061 anodized aluminum with an overall width Wi, height H, and thickness $T_1$ of about 86 mm, 20 mm, and 4 mm, respectively. The width of the horizontal gaps 1102 (i.e., the spacing between beams 1106 in the vertical direction) and the width of the vertical gaps 1104 (i.e., the spacing between beams 1106 in the horizontal direction) was about 0.5 mm. The beams 1106 had a depth of about 4.2 mm, a thickness measured between the upper and lower surfaces of each beam 1106 of about 1.4 mm, a width measured between the vertical sides of each beam 1106 of about 2.0 mm, and were oriented at approximately a 45 degree angle with respect to a vertical axis relative to a putting surface ground plane.

Example 9

A putter head 1400 was constructed of steel and included nineteen beams 1408 formed in the front surface 1406 of the putter head. The beams 1408 had a depth D1 of about 3.1 mm, a depth D2 of about 2.62 mm, a thickness Tb of about 0.40 mm, a gap width Wg of about 0.30 mm, and were oriented at approximately a 45 degree angle with respect to a vertical axis relative to a putting surface ground plane.

The inserts and putter described above in examples 1, 2, 5, and 9 were used to putt a golf ball. The physical characteristics and the "net shift" forward spin (measured in rpm) and frequency of beam oscillation for each example are shown in Table 1 below. The "net shift" forward spin is the difference between the forward spin of a golf ball struck with a putter having a substantially planar steel striking surface and the forward spin of an identical golf ball struck with a similarly shaped putter having deflectable beams, as measured shortly after impact. The testing method included six golfers, ten putts per putter per golfer, and 14-foot putts on a level and substantially planar putting surface. An indoor artificial putting surface was used primarily for consistency and to eliminate environmental variances. The spin of the ball was measured using a video camera system, as known in the art.

TABLE 1

| Example | Material | Beam angle (θ) | Beam depth, mm ($D_2$) | Beam thickness, mm ($T_b$) | Gap width, mm ($W_g$) | Net shift forward spin, rpm | Frequency (kHz) |
|---|---|---|---|---|---|---|---|
| Example 1 | ABS plastic | 45° | 2.62 | 0.89 | 0.30 | 80 ± 15 | 12.1 |
| Example 2 | 6061 anodized aluminum | 45° | 2.62 | 0.40 | 0.30 | 60 ± 15 | 43.9 |
| Example 5 | 6061 anodized aluminum | 45° | 2.62 | 0.89 | 0.30 | 30 ± 15 | 93.8 |
| Example 9 | 1018 steel | 45° | 2.62 | 0.40 | 0.30 | 40 ± 15 | 44.7 |

Computer simulations were performed on four different insert designs A, B, C, and D to predict the net shift forward spin compared to a standard steel putter head without any beams. The physical characteristics and the calculated net shift forward spin for each insert are reported below in Table 2.

TABLE 2

| Insert Design | Material | Beam angle (θ) | Beam depth, mm ($D_2$) | Beam thickness, mm ($T_b$) | Gap width, mm ($W_g$) | Net shift forward spin, rpm | Frequency (kHz) |
|---|---|---|---|---|---|---|---|
| A | 6061 anodized aluminum | 45° | 2.62 | 0.50 | 0.30 | 50 | 54.8 |
| B | 6061 anodized aluminum | 45° | 2.62 | 0.70 | 0.30 | 40 | 75.4 |
| C | Urethane | 55° | 2.62 | 0.70 | 0.30 | 200 | 6.1 |
| D | 6061 aluminum | 45° | 10.7 | 0.30 | 0.30 | 110 | 2.2 |

While any of the embodiments described herein can be used, a golf club head having an insert 1018 constructed of aluminum, the insert having beams 1028 oriented at an angle in the range of about 36 to 46 degrees, the beams having substantially flat end surfaces, a beam thickness of about 0.7 mm, a gap width between adjacent beams of about 0.3 mm, a frequency of oscillation in the range of about 12 kHz to about 95 kHz, and a compliant filler material at least partially filling the gaps has been found to be a suitable implementation of the present technology.

MCBC Material

The polymeric insert of the putters of the present invention may include a multi component blend composition ("MCBC") prepared by blending together at least three materials, identified as Components A, B, and C. These components may be melt processed to form in-situ, a polymer blend composition incorporating a pseudo-crosslinked polymer network.

The first of these blend components (blend Component A) include block copolymers incorporating a first polymer block having an aromatic vinyl compound, and a second polymer block having an olefinic or conjugated diene compound, including styrenic block copolymers such as styrene-butadiene-styrene (SBS), styrene-ethylene-butylene-styrene, (SEBS) and styrene-ethylene/propylene-styrene (SEPS). Commercial examples include SEPTON marketed by Kuraray Company of Kurashiki, Japan; TOPRENE by Kumho Petrochemical Co., Ltd and KRATON marketed by Kraton Polymers.

The second blend component, Component B, is a monomer, oligomer, prepolymer or polymer that incorporates at least five percent by weight of at least one type of an acidic functional group. Examples of such polymers suitable for use as include, but are not limited to, ethylene/(meth)acrylic acid copolymers and ethylene/(meth)acrylic acid/alkyl (meth)acrylate terpolymers, or ethylene and/or propylene maleic anhydride copolymers and terpolymers. Examples of such polymers which are commercially available include, but are not limited to, the Escor® 5000, 5001, 5020, 5050, 5070, 5100, 5110 and 5200 series of ethylene-acrylic acid copolymers sold by Exxon and the PRIMACOR® 1321, 1410, 1410-XT, 1420, 1430, 2912, 3150, 3330, 3340, 3440, 3460, 4311, 4608 and 5980 series of ethylene-acrylic acid copolymers sold by The Dow Chemical Company, Midland, Michigan and the ethylene-acrylic acid copolymers Nucrel 599, 699, 0903, 0910, 925, 960, 2806, and 2906 ethylene-methacrylic acid copolymers, sold by DuPont. Also included are the bimodal ethylene/carboxylic acid polymers as described in U.S. Pat. No. 6,562,906, the contents of which are incorporated herein by reference. These polymers comprise ethylene/α, β-ethylenically unsaturated $C_{3-8}$ carboxylic acid high copolymers, particularly ethylene (meth) acrylic acid copolymers and ethylene, alkyl (meth)acrylate, (meth)acrylic acid terpolymers, having a weight average molecular weight, Mw, of about 80,000 to about 500,000 which are melt blended with ethylene/α, β-ethylenically unsaturated $C_{3-8}$ carboxylic acid copolymers, particularly ethylene/(meth)acrylic acid copolymers having weight average molecular weight, Mw, of about 2,000 to about 30,000.

Component C is a base capable of neutralizing the acidic functional group of Component B and is a base having a metal cation. These metals are from groups IA, IB, IIA, IIB, IIIA, IIIB, IVA, IVB, VA, VB, VIA, VIB, VIIB and VIIIB of the periodic table. Examples of these metals include lithium, sodium, magnesium, aluminum, potassium, calcium, manganese, tungsten, titanium, iron, cobalt, nickel, hafnium, copper, zinc, barium, zirconium, and tin. Suitable metal compounds for use as a source of Component C are, for example, metal salts, preferably metal hydroxides, metal oxides, metal carbonates, metal acetates, metal stearates, metal laureates, metal oleates, metal palmitates and the like.

The composition preferably is prepared by mixing the above materials into each other thoroughly, either by using a dispersive mixing mechanism, a distributive mixing mechanism, or a combination of these. As a result of this mixing, the anionic functional group of Component A is dispersed evenly throughout the mixture. Most preferably, Components A and B are melt-mixed together without Component C, with or without the premixing discussed above, to produce a melt-mixture of the two components. Then, Component C separately is mixed into the blend of Components A and B. This mixture is melt-mixed to produce the reaction product. This two-step mixing can be performed in a single process, such as, for example, an extrusion process using a proper barrel length or screw configuration, along with a multiple feeding system.

Additional Polymer Components for the Putter Insert

Other polymeric materials that can be useful for making a putter insert may also be included as either an additional blend component of the modified ionomer composition or as one or more of the components of the putter insert of the present invention. These include, without limitation, synthetic and natural rubbers, thermoset polymers such as other thermoset polyurethanes or thermoset polyureas, as well as thermoplastic polymers including thermoplastic elastomers such as metallocene catalyzed polymer, unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, thermoplastic polyurethanes, thermoplastic polyureas, polyamides, copolyamides, polyesters, copolyesters, polycarbonates, polyolefins, halogenated (e.g. chlorinated) polyolefins, halogenated polyalkylene compounds, such as halogenated polyethylene [e.g. chlorinated polyethylene (CPE)], polyalkenamer, polyphenylene oxides, polyphenylene sulfides, diallyl phthalate polymers, polyimides, polyvinyl chlorides, polyamide-ionomers, polyurethane-ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, which is hereby incorporated by reference in its entirety), ethylene vinyl acetates, polyureas, and polysiloxanes and any and all combinations thereof.

PEBAX Material

Thermoplastic elastomers for use within the scope of the present invention include polyester elastomers marketed under the name SKYPEL by SK Chemicals of South Korea or HYTREL from DuPont. Also of use are triblock copolymers marketed under the name HG-252 by Kuraray Corporation of Kurashiki, Japan. These triblock copolymers have at least one polymer block comprising an aromatic vinyl compound and at least one polymer block comprising a conjugated diene compound, and a hydroxyl group at a block copolymer. Also preferred are polyamide elastomers and in particular polyetheramide elastomers. Of these, suitable thermoplastic polyetheramides are chosen from among the family of PEBAX resins, which are available from Elf-Atochem Company.

In addition, a sound-altering material for the putter inserts of the present invention may be selected from any number of materials, including those that have traditionally been used as weight fillers or as processing aids (such as those described in U.S. Pat. No. 7,163,471, to Kim et al, which is hereby incorporated by reference in its entirety). The preferred materials include carbonates, sulfates, glass beads and metal stearates. In particular, carbonates sulfates, and hollow glass beads generally function to dampen the sound of a cover material. In contrast, metal stearates and solid glass beads tend to enhance the sound of the cover material. The preferred sound-altering materials include: zinc stearate supplied by AkroChem of Akron, Ohio; soda-lime glass spheres with a coupling agent, or borosilicate glass spheres with a coupling agent, supplied by Potter Industries, Inc. of Valley Forge, Pa.; and Hubberbrite 3 (barium sulfate having a median particle size 3.2 microns) and Hubberbrite 10 (barium sulfate having a median particle size of 9.0 microns) supplied by JM Huber Corp., Edison, N.J. When glass beads are used as the sound-altering material, any conventional surface treatment may be added to the beads for promoting adhesion between the surface of the glass beads and the base material of the composition. Silanes are particularly useful in these surface treatments.

The polymeric base composition and sound-altering material can be mixed together to form the composition of the present invention, with or without melting them. Dry blending equipment, such as a tumbler mixer, V-blender, or ribbon blender, can be used to mix the compositions. The sound-altering material can be mixed together with the base composition or constituents of the base composition. The sound-altering material also can be added after addition of any of the additional materials discussed above. Materials can be added to the composition using a mill, internal mixer, extruder or combinations of these, with or without application of thermal energy to produce melting. In another method of manufacture of these compositions, the sound-altering material can be premixed with the base composition to produce a concentrate having a high concentration of sound-altering material. Then, this concentrate can be introduced into a composition of base composition urethane and additional materials using dry blending, melt mixing or molding. The additional materials also can be added to a color concentrate, which is then added to the composition to impart a white color to the putter insert.

Depending on the insert material, various amounts of positive forward roll can be achieved. Polymer materials can have a softer feel and a more dampened sound when compared to an aluminum insert. For example, an aluminum putter insert can have 15-25 RPM of positive roll when compared to a PEBAX material which can have about 0-5 RPM of positive roll.

FIG. 1D illustrates a bottom view of the putter head 100 including the sole portion 160 having a gasket material 162*a*, 162*b* between the central portion 110 and the frame 112. In one embodiment, the gasket material 162*a*, 162*b* extends along the entire engagement surface between the central portion 110 and the frame 112 in order to provide a tighter fit and prevent damage or unwanted sound or vibration during use. In other words, the gasket material isolates the central portion 110 from the frame 112.

Figure 1E:
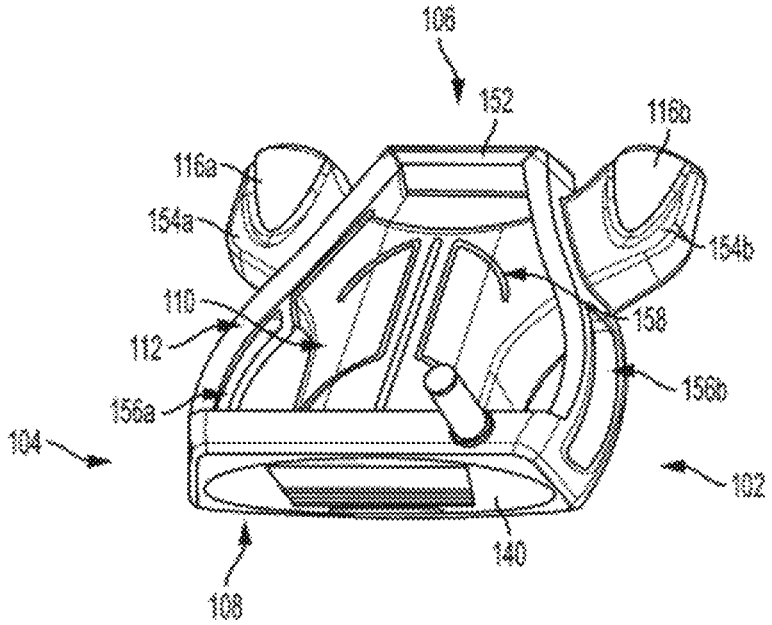
FIG. 1E is an isometric view of the golf club head of FIG. 1A.

FIG. 1E illustrates an isometric view of the putter head 100 showing a decreasing overall thickness of the central portion 110 in the Y-direction (excluding the weight ports). The central portion 110 primarily attaches near the face portion 118 and at the central portion 110 and frame 112 intersection in the gasket material regions described above.

Figure 2A:
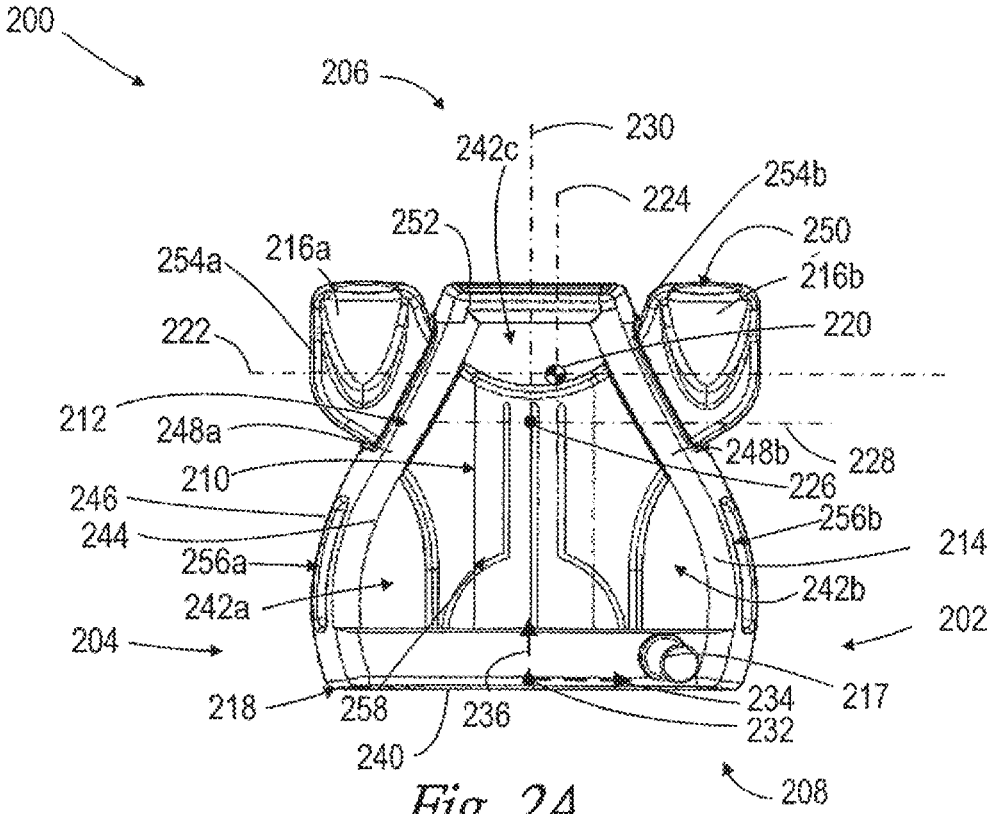
FIG. 2A is a top view of a representative golf club head, according to a second embodiment.

FIG. 2A shows a top view of another embodiment showing a "two piece" putter head 200 similar to the embodiment shown in FIGS. 1A-1E. However, the embodiment shown in FIGS. 2A-2E is generally about 20% smaller in size. The putter head 200 includes a heel side 202, a toe side 204, at top portion 261, a sole portion 260, a rear portion 206, and a front portion 208. The putter head 200 further includes a central portion 210 and a frame 212. The frame 212 includes a rim 214 having a back portion 252 and two side portions 248*a*, 248*b*. Moreover, the putter head 200 includes a face portion 218, a hosel 217, an inner peripheral contour 244, an outer peripheral contour 246, two weight ports 216*a*, 216*b*, two flange portions 254*a*, 254*b*, two slots 256*a*, 256*b*, a face insert 240, three gaps 242*a*, 242*b*, 242*c*, and an alignment indicia 258.

In one embodiment, the alignment indicia 258 includes a centerline that is substantially straight and parallel with a Y-axis 236 and two flanking lines on each side of the centerline. The flanking lines are parallel with the centerline for a substantial portion of the length and then form two arc segments that extend toward the face portion 218. The two arc segments form a quarter-circular shape near the face portion 218 having a radius similar to that of a golf ball for ease of alignment with a golf ball. In addition, the two arc segments are configured to resemble a semi-circle when viewed by the golfer.

As previously described, the putter head includes a CG location 220, a CG X-axis 222, a CG Y-axis 224, and a CG Z-axis 223. FIG. 2A also shows a geometric center 226, a horizontal dashed center X-axis 228, and a vertical dashed center Y-axis 230, as described above.

In one embodiment, the club head 200 has a general maximum width dimension of about 93 mm, a maximum length dimension of about 86 mm, and a maximum height dimension of about 25 mm.

In one embodiment, the CG location 220 includes a CGx of about 0.8 mm, a CGy of about 36.2 mm and a CGz of about 13.2 mm.

In one embodiment, the club head 200 has an $I_{xx}$ value of about 2,989 g·cm$^2$, an $I_{yy}$ value of about 2,804 g·cm$^2$, and an $I_{zz}$ value of about 5,378 g·cm$^2$.

In certain embodiments, the central portion 210 is comprised of an aluminum hollow body having a mass of about 76 g. In addition, the frame 212 is a steel frame having a mass of about 233 g. Upon assembly, the entire mass of the club head including gaskets and weights 250 is about 347.6 g In one preferred embodiment, about 73% (footprint about 3,141 mm$^2$) of the central portion 210 is enclosed by the frame 212 while about 27% (footprint about 1,168 mm$^2$) of the central portion 210 is located outside of the frame 212 across an X-Y plane. In other embodiments, about 55-95% of the central portion 210 is contained within the peripheral contours of the rim 214 across an X-Y plane. In one embodiment, the central portion 210 footprint is about 4,309 mm$^2$.

The weight distribution of the embodiment shown in FIGS. 2A-2E can provide about 60% of the total weight behind the projected width of a ball located at an ideal ball impact location along the Y-axis 236 and about 20% on each of the toe 204 and heel 202 portions.

In one example, the embodiment shown in FIGS. 2A-2E has the footprint value and striking surface width of Example 2 shown in Table 1. In one embodiment, the weight of the central portion 210 inside the inner peripheral edge of the frame is about 58 g (used to calculate the IPWR).

Figure 2B:
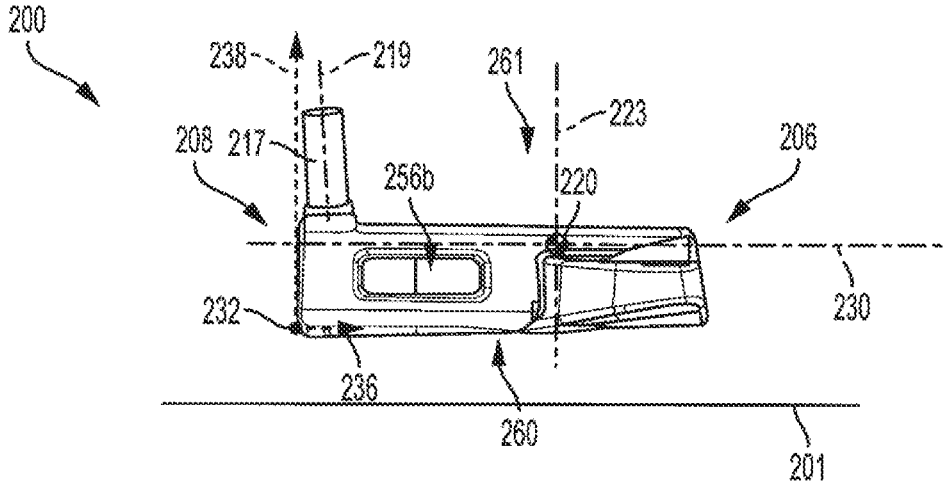
FIG. 2B is an elevated side view of the golf club head of FIG. 2A.

FIG. 2B shows a side view having a ground center location 232, a ground center X-axis 234, a ground center Y-axis 236, and ground center Z-axis 238.

Figure 2C:
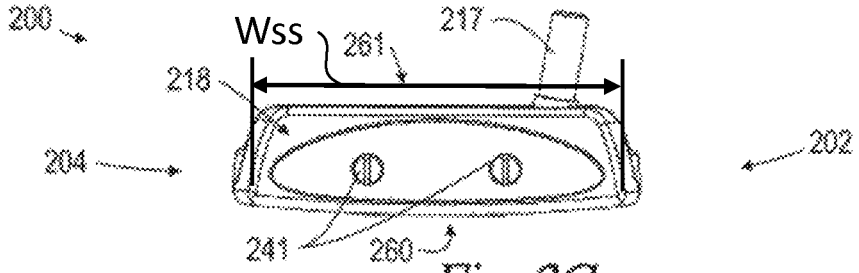
FIG. 2C is an elevated front view of the golf club head of FIG. 2A.
Figure 2D:
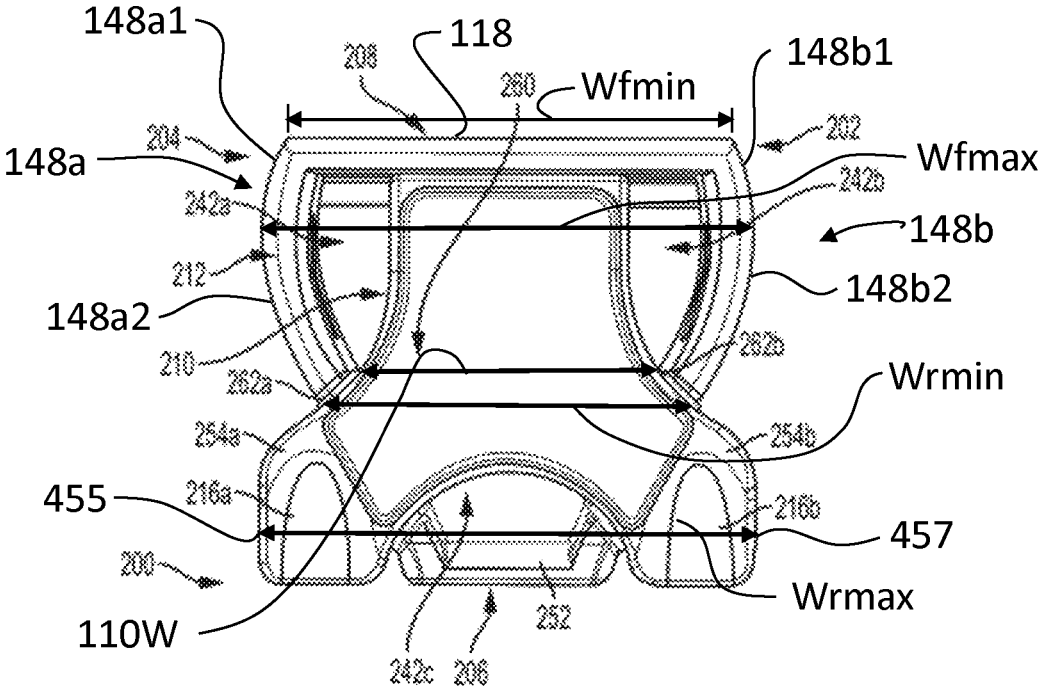
FIG. 2D is a bottom perspective view of the golf club head of FIG. 2A.

FIG. 2C shows a front view of the putter 200 with a face insert 240 removed. Two screws or bolts 241 are shown within two countersink or counterbore holes that extend through the face portion 218. The two screws or bolts 241 are tapped into the central portion 210 for maintaining contact between the frame 212 and central portion 210.

Figure 2E:
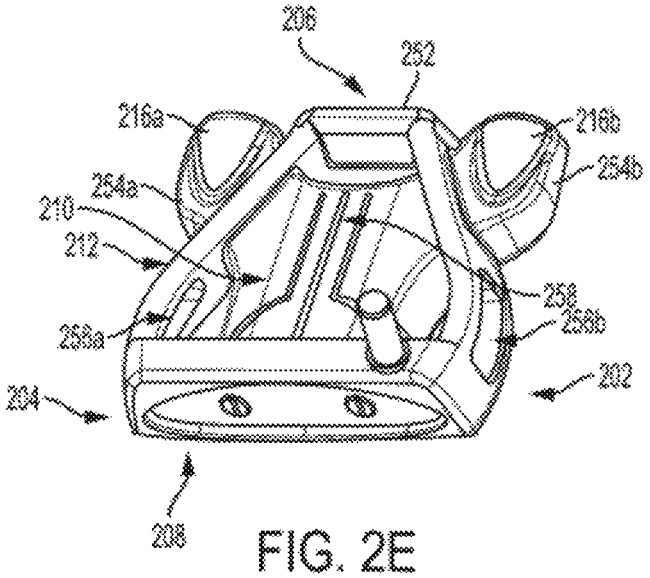
FIG. 2E is an isometric view of the golf club head of FIG. 2A.

FIG. 2D shows a bottom view of the putter 200 with a gasket material 262*a*,262*b* as previously described. The sole portion 260 can include a sole plate comprised of a metallic material such as aluminum or steel. FIG. 2E shows an isometric view of the putter 200 having similar features already described above.

FIGS. 3A-3E show various views of another embodiment, of a "single piece" cast stainless steel putter 300. It is understood that the embodiment shown could also be a "two piece" construction similar to those described above. The putter 300 includes a heel side 302, a toe side 304, a top portion 361, a sole portion 360, a rear portion 306, and a front portion 308. The putter head 300 further includes a central portion 310 and a frame 312. The frame 312 includes a rim 314 having a back portion 352 and two side portions 348*a*, 348*b*. Moreover, the putter head 300 includes a face portion 318, a hosel 317, an inner peripheral contour 344, an outer peripheral contour 346, two flange portions 354*a*, 354*b*, two slots 356*a*, 356*b*, a face insert 340, three gaps 342*a*, 342*b*, 342*c*, and an alignment indicia 358.

Figure 3A:
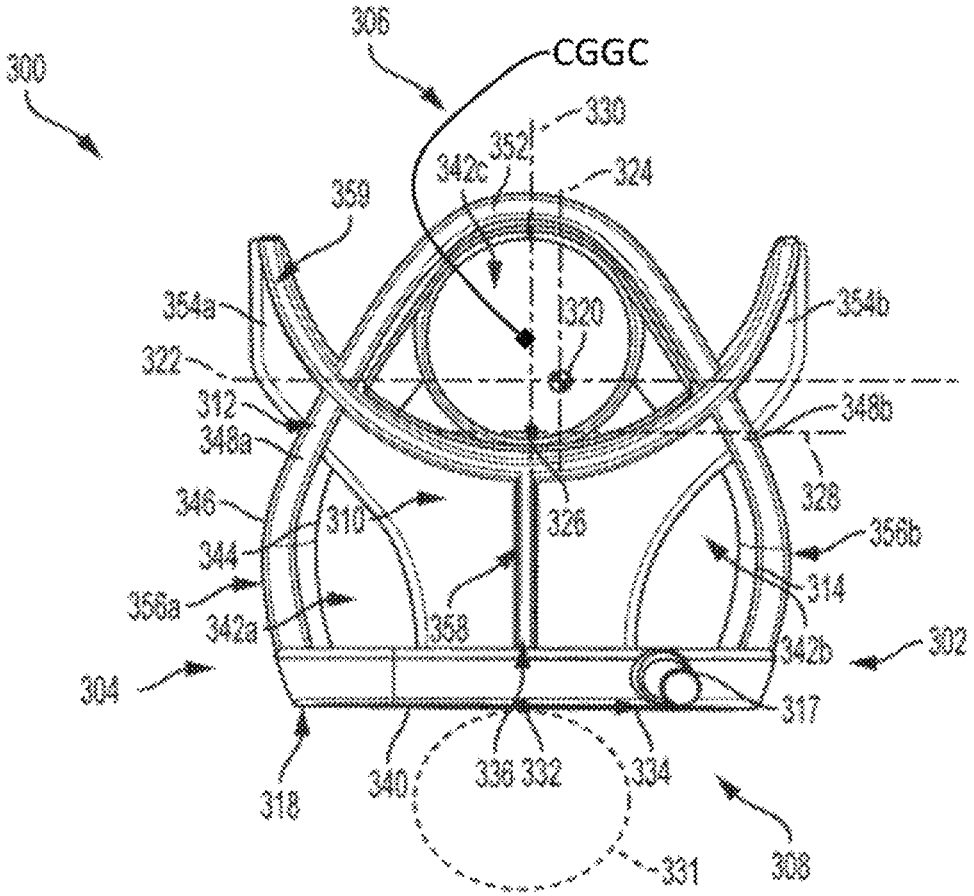
FIG. 3A is a top view of a representative golf club head, according to a third embodiment.

Referring to FIG. 3A, the alignment indicia 358 includes a single centerline that is substantially straight and parallel with the center Y-axis 330 and connects with an arc or cup line 359 that extends between the two flange portions 354*a*,354*b*. With respect to the frame 312, the arc or cup line 359 has two ends that extend outside of the enclosed frame 312 area and forms a contiguous semi-circular shape. The arc or cup line 359 is curved away from the face portion 318 in the positive Y-direction so that a center point of the arc is located away from the face portion 318 along the center Y-axis 330 toward the rear portion 306 of the putter head 300. The arc or cup line 359 is intended to resemble the back of a golf cup and has the same radius of about 53.975 mm (about 2.125") as a golf cup. In one embodiment, the arc or cup line 359 is located on top of a raised surface or rib that extends across the top of the club head 300.

Furthermore, the third gap 342*c*, also referred to as a central gap, defines a circular shape that is immediately adjacent to the arc or cup line 359. The sole portion 360 defines the circular third gap 342*c* that is located between the arc or cup line 359 and the frame 312. In one embodiment, the diameter of the circular third gap 342*c* is about 40-42.6 mm. As seen in FIG. 3A, the central gap 342*c* has a central gap geometric center CGGC, and the back portion 352 may be a curved back portion.

In some embodiments, the circular third gap 342*c* is slightly smaller than the diameter of a golf ball so that a user can place the ball on top of the golf head above the circular third gap 342*c*. In other words, the circular third gap 342*c* can act as a ball holder so the user can lift the ball from the ground with the putter head 300 without bending over and manually picking up the ball. In other embodiments, the circular third gap 342*c* is the same diameter as a golf ball to enable the user to better visualize the golf ball hitting the "back of the cup".

In addition, when the putter head 300 is aligned with the ball 331, a "ball-line-ball" arrangement is visually created for the golfer. The "ball-line-ball" arrangement includes the ball 331, the centerline of the indicia 358, and the third gap 342*c*. The "ball-line-ball" arrangement better enables the golfer to align the ball 331 with the centerline of the putter head 300. The distance between the third gap 342*c* and the ball 331 is large enough that a misalignment would easily be recognized by a golfer. In one embodiment, the distance between the center of the ball 331 and the center of the third gap 342*c* along the Y-axis is about 100 mm.

As previously described, the putter head includes a CG location 320, a CG X-axis 322, a CG Y-axis 324, and a CG Z-axis 323. FIG. 3A also shows a geometric center 326, a horizontal dashed center X-axis 328, and a vertical dashed center Y-axis 330, as described above.

In one embodiment, the club head 300 has a general maximum width dimension of about 109 mm, a maximum length dimension of about 104 mm, and a maximum height dimension of about 24 mm.

In one embodiment, the CG location 320 includes a CGx of about 0.8 mm, a CGy of about 36.9 mm and a CGz of about 11.4 mm.

In one embodiment, the club head 300 has an $I_{xx}$ value of about 3,072 g·cm$^2$, an $I_{yy}$ value of about 3,476 g·cm$^2$, and an $I_{zz}$ value of about 6,204 g·cm$^2$.

In certain embodiments, the central portion 310 and the frame 312 are comprised of single cast piece having a total mass of about 354.8 g. The embodiment shown in FIGS. 3A-3E has the advantage of minimal assembly since the putter head 300 is a "single piece" construction.

In one preferred embodiment, about 81% (footprint about 3,530 mm$^2$) of the central portion 310 is enclosed by the frame 312 while about 19% (footprint about 826 mm$^2$) of the central portion 310 is located outside of the frame 312 across an X-Y plane. In other embodiments, about 55-95% of the central portion 310 can be contained within the outer peripheral contours of the rim 314 across an X-Y plane. In one preferred embodiment, the total footprint of the central portion 312 is about 4,356 mm$^2$.

In one embodiment, the putter head 300 shown in FIGS. 3A-3E has the footprint value and striking surface width of Example 3 shown in Table 1.

Figure 3B:
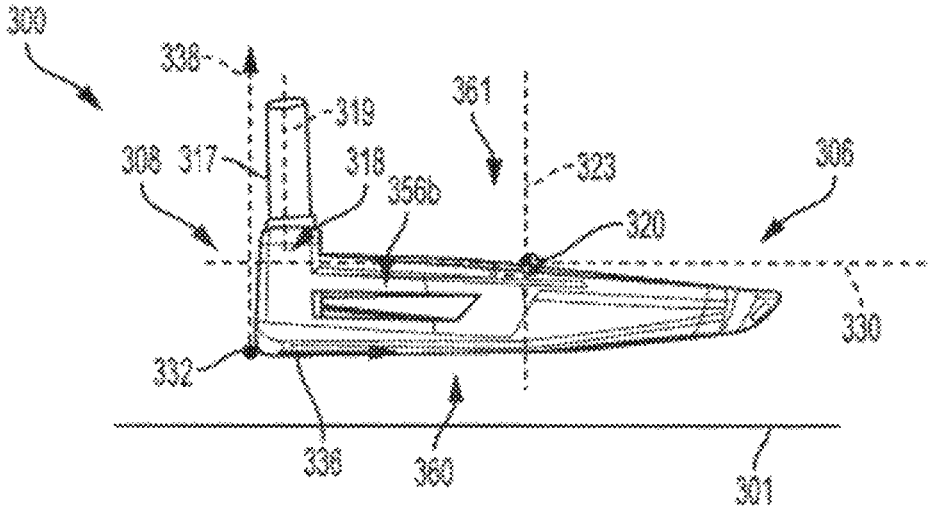
FIG. 3B is an elevated side view of the golf club head of FIG. 3A.

FIG. 3B shows a side view of the club head 300 having a ground center location 332, a ground center X-axis 334, a ground center Y-axis 336, and ground center Z-axis 338. In addition, the top portion 361 and sole portion 360 profiles as seen from the side view show the club head tapering inwardly as it extends in along the ground center Y-axis 336. The height dimension of the putter progressively decreases along the Y-axis 336 by a tapering top portion 361 and sole portion 360 profiles as viewed from the side view. In certain embodiments described above, the tapering of the sole portion 160, 260, 360 profile along a Y-axis can prevent unwanted contact between the bottom of the putter head 300 and the ground surface during a putting stroke.

In one embodiment, the height of the frame 312 and central body portion 310 (with respect to the ground) are stepped down or lower than the face portion 318 in the negative Z-direction and thereby effectively lowering the CG.

Figure 3C:
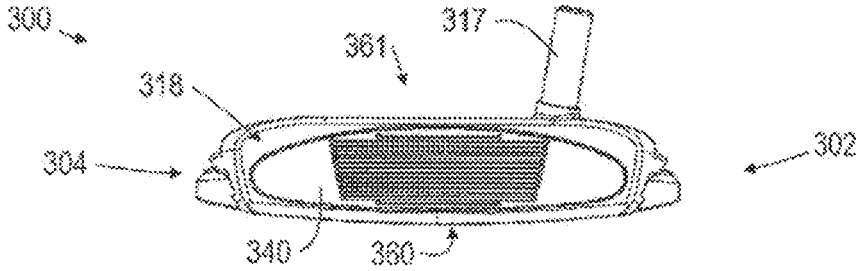
FIG. 3C is an elevated front view of the golf club head of FIG. 3A.

FIG. 3C shows a front view of the club head 300 with the putter insert 340 which can include any of the putter inserts or grooves previously described. In any of the above-described embodiments, a loft of about 2.5° can be provided.

Figure 3D:
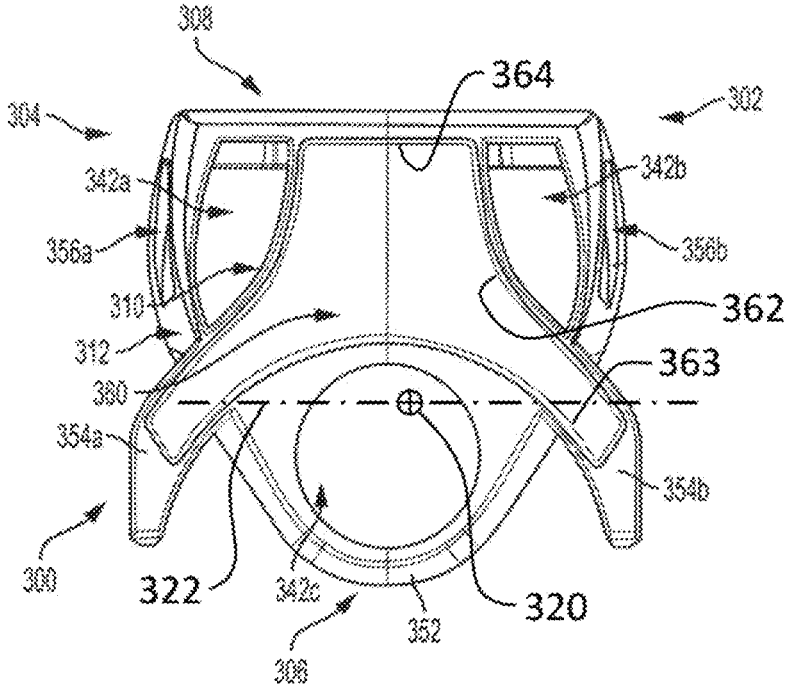
FIG. 3D is a bottom perspective view of the golf club head of FIG. 3A.
Figure 3E:
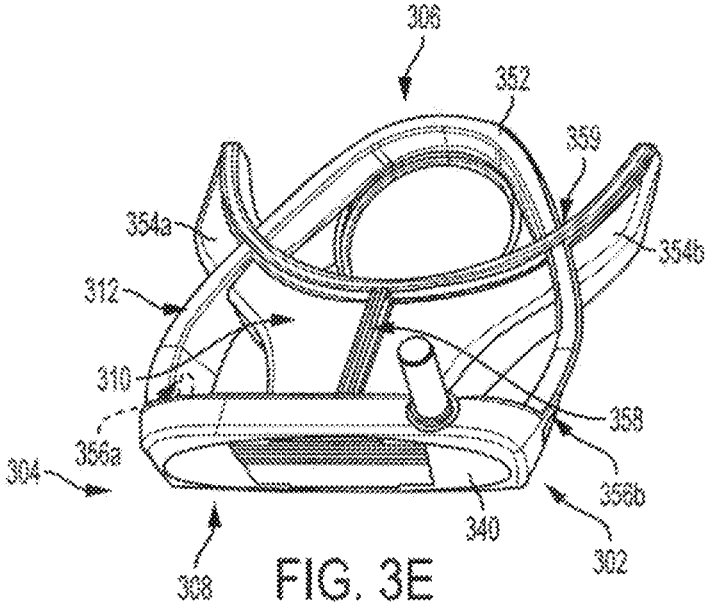
FIG. 3E is an isometric view of the golf club head of FIG. 3A.

FIG. 3D shows a bottom view of the putter head having the sole portion 360 that includes a sole plate 362 that attaches to a bottom surface of the central portion 310. In one embodiment, the sole plate 362 is a non-metallic plastic, composite, or polymer plate. In at least some embodiments, as illustrated in, e.g., FIGS. 3C and 3D, the sole plate 362 may comprise a heel-toe width that is greater than the width of the face portion and/or the face insert 340 of the putter head. The sole plate 362 has a sole plate rear edge 363 and a sole plate forward edge 364. A portion of the sole plate rear edge 363 may be located rearward of the center of gravity 320, and may be curved, as seen in FIG. 3D. A portion of the sole plate forward edge 364 may be located forward of the center of gravity 320, and may be straight, also seen in FIG. 3D. In such embodiments: a heelward portion of the sole plate may extend heelwardly of the face insert, a toeward portion of the sole plate may extend toewardly of the face insert, or both. Furthermore, the frame 312 includes a toe slot 356 a and a heel slot 356*b* that do not extend through the thickness of the frame 312. The two slots 356*a*, 356*b* are indented slots and not through-hole slots. It is understood that the slots can be designed as through-hole slots without departing from the scope of the invention. FIG. 3E shows an isometric view of the putter 300 having similar features already described above.

Figure 4A:
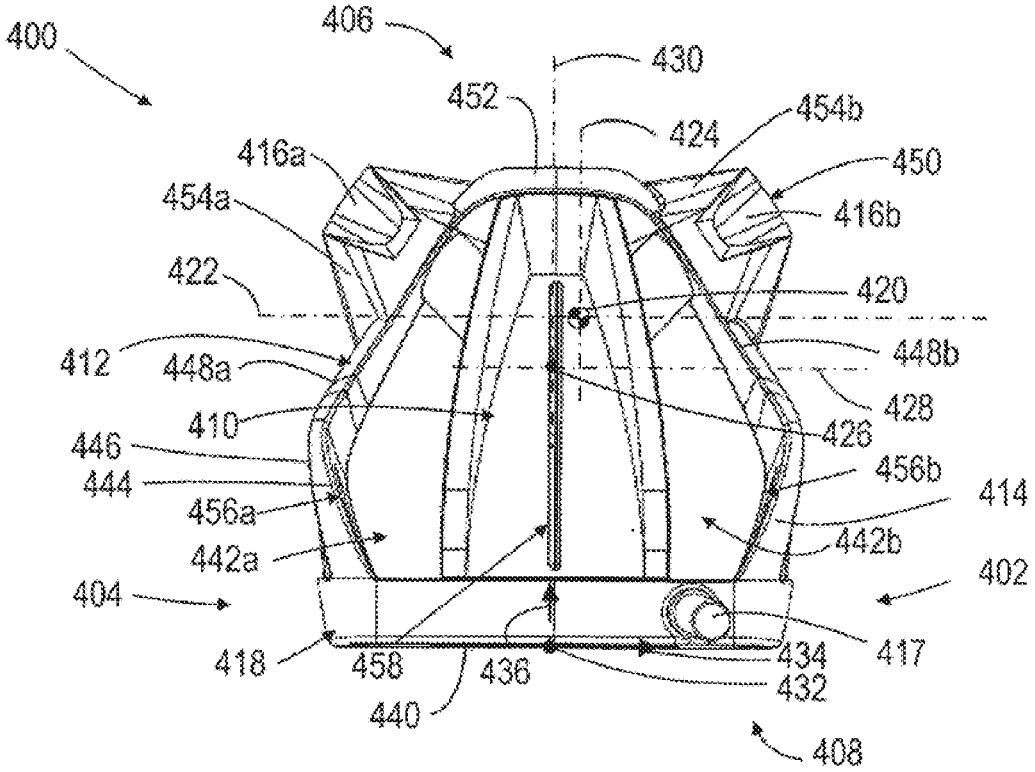
FIG. 4A is a top view of a representative golf club head, according to a fourth embodiment.

FIG. 4A shows a top view of another embodiment showing a "two piece" putter head 400. The putter head 400 includes a heel side 402, a toe side 404, at top portion 461, a sole portion 460, a rear portion 406, and a front portion 408. The putter head 400 further includes a central portion 410 and a frame 412. The frame 412 includes a rim 414 having a back portion 452 and two side portions 448*a*, 448*b*. Moreover, the putter head 200 includes a face portion 418, also referred to as a striking surface having a striking surface width Wss, seen in FIGS. 1C, 2C, and 4C, a hosel 417, an inner peripheral contour 444, an outer peripheral contour 446, two weight ports 416*a*, 416*b*, two flange portions 454*a*, 454*b*, also generally referred to as a toe outboard extension and a heel outboard extension, two slots 456*a*, 456*b*, a face insert 440, two gaps 442*a*, 442*b* and an alignment indicia 458. A heelwardmost point 457 on the heel side outboard extension and a toewardmost point 455 on the toe side outboard extension are illustrated in FIGS. 1D, 2D, and 4D.

In one embodiment, the alignment indicia 458 includes a centerline that is substantially straight and parallel with a Y-axis 436 extending primarily along the length of the central portion 410.

As previously described, the putter head includes a CG location 420, a CG X-axis 422, a CG Y-axis 424, and a CG Z-axis 423. FIG. 4A also shows a geometric center 426, a horizontal dashed center X-axis 428, and a vertical dashed center Y-axis 430, as described above. As seen in FIG. 4D, as well as FIGS. 1D and 2D, the geometric center 426, 126 divides the putter head into a forward portion and a rearward portion, with the forward portion being the portion of the putter head in front of the geometric center X-axis 128 passing through the geometric center 426, 126 toward the striking surface. The forward portion has a forward maximum external perimeter width (Wfmax) and a forward minimum external perimeter width (Wfmin), which is is less than the forward maximum external perimeter width (Wfmax). Thus, the forward maximum external perimeter width (Wfmax) occurs at a forward maximum width location in the forward portion, and the forward minimum external perimeter width (Wfmin) occurs at a forward minimum width location in the forward portion. The rearward portion has a rearward maximum external perimeter width (Wrmax) between the heelwardmost point 457 and the toewardmost point 455. The rearward portion also has a rearward minimum external perimeter width (Wrmin) located at a rearward minimum width location in the rearward portion. The rearward maximum external perimeter width (Wrmax) is greater than the rearward minimum external perimeter width (Wrmin). In FIGS. 1D, 2D, and 4D, the rearward minimum external perimeter width (Wrmin) is less than the forward minimum external perimeter width (Wfmin). In FIG. 4A a maximum outer periphery width between the heel side flange portion 454*b* and the toe side flange portion 454*a* is greater than the striking surface width Wss. The rearward minimum external perimeter width (Wrmin) and the rearward maximum external perimeter width (Wrmax) may be described as a rear lateral width of the golf club putter head located rearward of the toe gap and the heel gap. A portion of the central body portion 110 bounds the heel gap and the toe gap, and a maximum bounding CBP width 110W, seen in FIG. 1D, is seen at the rear end of the heel gap and the toe gap.

In one embodiment, the club head 400 has a general maximum width dimension of about 97 mm, a maximum length dimension of about 97 mm, and a maximum height dimension of about 25 mm.

In one embodiment, the CG location 420 includes a CGx of about 0.9 mm, a CGy of about 42.3 mm and a CGz of about 12.2 mm.

In one embodiment, the club head 400 has an Ix value of about 4,227 g·cm$^2$, an $I_{yy}$ value of about 3,474 g·cm$^2$, and an $I_{zz}$ value of about 7,296 g·cm$^2$.

In certain embodiments, the central portion 410 is comprised of a plastic, polymer, nylon or ABS hollow body having a mass of about 55 g. In addition, the frame 412 is a steel frame having a mass of about 280 g. Upon assembly, the entire mass of the club head including weights 450 is about 353.4 g In one preferred embodiment, about 100% of the central portion 410 is enclosed by the frame 412 across an X-Y plane. The central weight portion ratio is about 0.16, in one embodiment.

In one embodiment, the central portion 410 is substantially hollow having reinforced ribs or walls inside the central portion. Because, the central portion 410 is a plastic or lightweight material, an advantageous CG location and mass distribution is achieved. In addition, the central portion is configured to provide improved sound dampening upon impact.

Figure 4B:
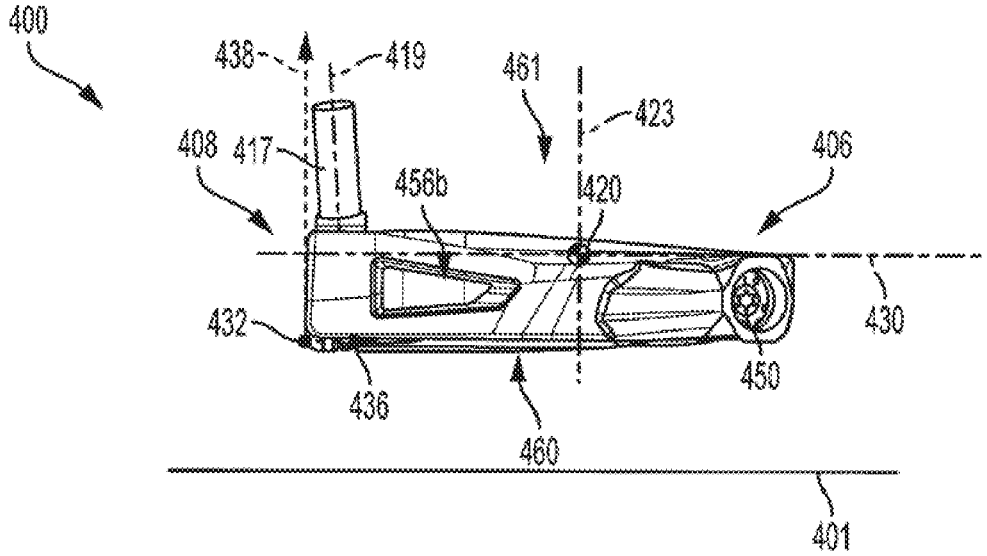
FIG. 4B is an elevated side view of the golf club head of FIG. 4A.

FIG. 4B shows a side view having a ground center location 432, a ground center X-axis 434, a ground center Y-axis 436, and ground center Z-axis 438.

Figure 4C:
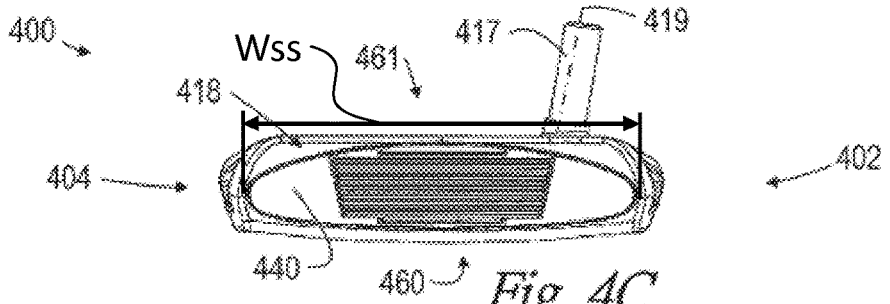
FIG. 4C is an elevated front view of the golf club head of FIG. 4A.
Figure 4D:
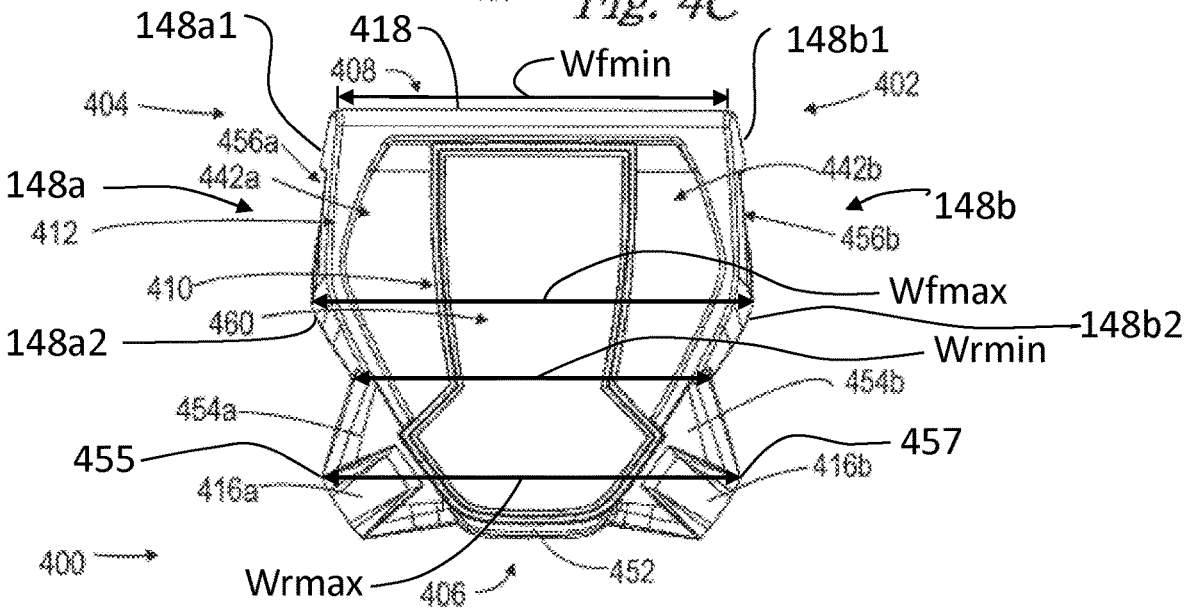
FIG. 4D is a bottom perspective view of the golf club head of FIG. 4A.

FIG. 4C shows a front view of the putter 400 with a face insert 440 having grooves located on the face insert 440, as previously described.

Figure 4E:
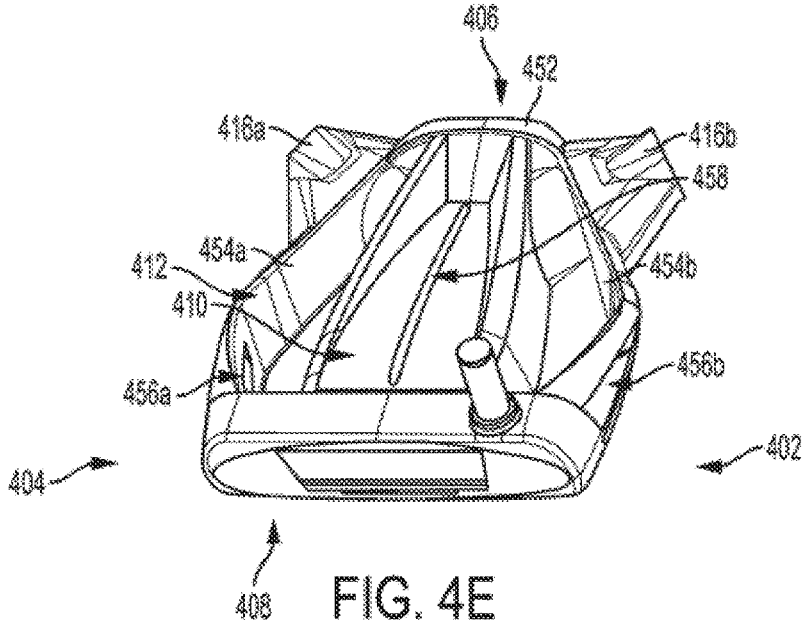
FIG. 4E is an isometric view of the golf club head of FIG. 4A.

FIG. 4D shows a bottom view of the putter 400. The sole portion 460 can include a sole plate comprised of a plastic material similar to the material utilized for the central portion 410. FIG. 4E shows an isometric view of the putter 400 having similar features already described above.

Figure 5A:
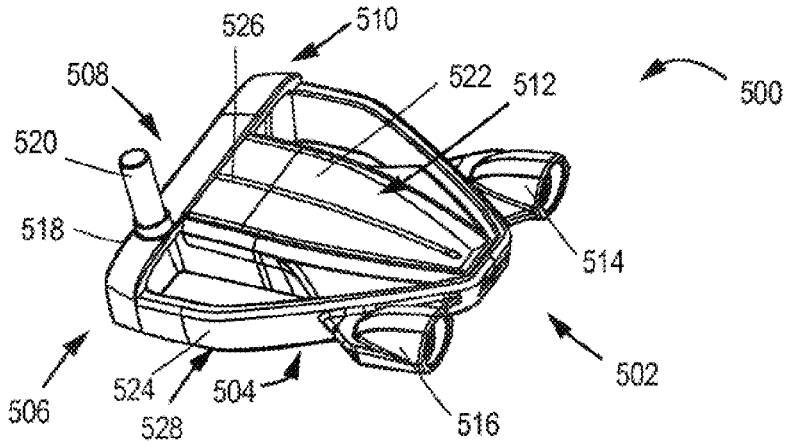
FIG. 5A illustrates an isometric view of a golf club head, according to a fifth embodiment.

FIG. 5A illustrates another exemplary embodiment of another "two piece" putter head 400. The putter head 500 includes a heel side 506, a toe side 510, at top portion 512, a sole portion 504, a rear portion 502, and a front portion 508. The putter head 500 further includes a central portion 512 and a 360° perimeter frame 524. The perimeter frame 524 encloses a central portion 512 (within an x-y plane as previously described). Moreover, the putter head 500 includes a face portion 518, a hosel 520, two weight ports 514, and an alignment indicia 526.

As previously described, the putter head includes a CG location, a CG X-axis, a CG Y-axis, and a CG Z-axis as previously defined.

In one embodiment, the club head 400 has a general maximum width dimension of about 100 mm, a maximum length dimension of about 97 mm, and a maximum height dimension of about 25 mm.

In one embodiment, the CG location includes a CGx of between about-5.0 mm and about 5 mm, a CGy of between about 40 mm and 45 mm or about between about 30 mm and 50 mm and a CGz of between about 10 mm and about 13 mm or between about 9 mm and about 15 mm from a ground center point location.

In one embodiment, the club head 500 has an $I_{xx}$ value of about 3,617 g·cm$^2$ or between about 3,500 g·cm$^2$ and about 3,800 g·cm$^2$, an $I_{yy}$ value of about 3,117 g·cm$^2$ or between about 3,000 g·cm$^2$ and about 3,500 g·cm$^2$, and an $I_{zz}$ value of about 6,355 g·cm$^2$ or between about 6,000 g·cm$^2$ and about 6,500 g·cm$^2$.

In certain embodiments, the central portion 512 includes a crown 522 comprised of an injection molded plastic material, polymer, nylon or ABS hollow body having a mass of about 19 g or less than 20 g or between about 5 g and 20 g. In other embodiments, the central portion 512 is between about 5 g and about 35 g. In one embodiment, the central portion crown 512 is a single molded ABS plastic piece made of a material having a density less than 4.5 g/cc.

In addition, the body frame 528 is a steel frame having a mass of about 318 g. Upon assembly, the entire mass of the club head including the removable weights is about 352 g or between 340 g and about 360 g or between about 300 g and 400 g.

In one preferred embodiment, about 100% of the central portion 512 is enclosed by the frame rim 524 across an X-Y plane. The central weight portion ratio is about 0.05 as shown in Example 4 of Table 1. The SS Width, Effective Footprint, Actual Footprint, Footprint Ratio, and IPWR are also listed in Example 4 of Table 1.

Figure 5B:
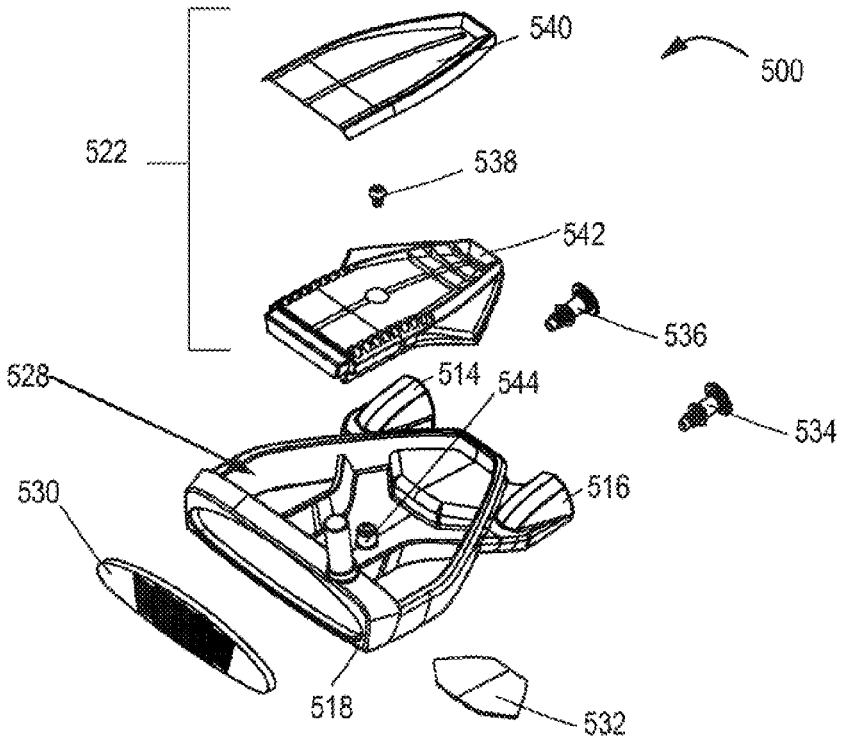
FIG. 5B illustrates an exploded view of the golf club head of FIG. 5A.

FIG. 5B illustrates an exploded assembly drawing of the embodiment shown in FIG. 5A. The crown portion 522 includes a metallic steel plate 540 that is adhesively attached to a lightweight portion 542 that is a single molded ABS plastic piece made of a material having a density less than 4.5 g/cc. The metallic plate 540 provides the appearance of a solid crown portion to the golfer even though significant weight savings is achieved by the lightweight portion 542. In one embodiment, the metallic plate 540 is about 7 g or less than about 10 g or between about 3 g and about 10 g. The plate 540 can be a composite carbon fiber material or any other lightweight material.

The lightweight portion 542 is attached to the body frame 528 via an attachment screw or locking mechanism 538 that is inserted into an opening located on the top surface of the lightweight portion 542. The locking mechanism 538 engages with a receiving boss 544 located on the body frame. In one embodiment, the inner bore of the receiving boss 544 is threaded to allow engagement with the locking mechanism 538.

Furthermore, two weights 536,534 are inserted into the weight ports as previously described. A sole plate 532 can be optionally inserted into a pocket in the sole portion 504. A putter insert 530 is inserted into the face portion 518 of the club head.

Figure 6:
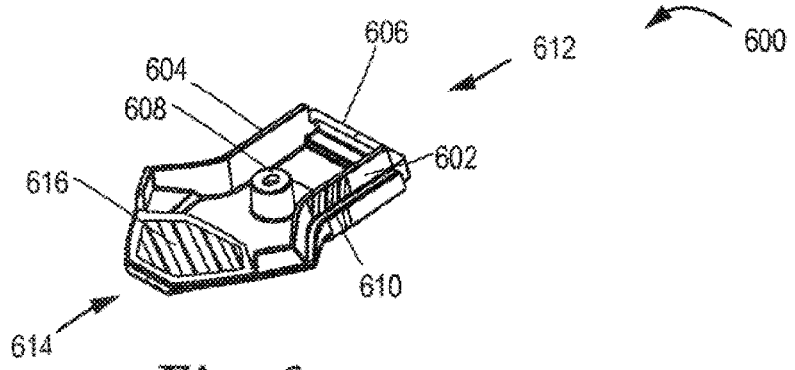
FIG. 6 illustrates an isometric view of a lightweight crown portion.

FIG. 6 illustrates an exemplary lightweight crown portion 600 made of a lightweight material described above. The lightweight crown portion 600 includes a front portion 612 and a rear portion 614. A first side wall 602 and a second side wall 604 define a cavity portion within the putter head created by the lightweight crown portion 600. The first side wall 602 and second side wall 604 extend between the front portion 612 and rear portion 614 and engage with an inner surface of the central portion of the putter. When the putter head is fully assembled, a gasketing material 610 can be provided on the outer surface of the first side wall 602 and second side wall 604. In addition, a rear gasketing material 616 can be applied to the crown portion which also ensures a dampened engagement between the lightweight crown portion 600 and the central portion that engages with the crown portion 600. A front wall 606 includes an adhesive material, such as double sided tape, which secures the top crown portion 600 to a rear surface of the front portion of the putter head. It is understood that any surface shown may include a gasket or adhesive tape to securely attach the crown portion 600.

Furthermore, the lightweight crown portion 600 includes a recess 608 which receives the fastening member on the top of the crown portion 600.

Figure 7:
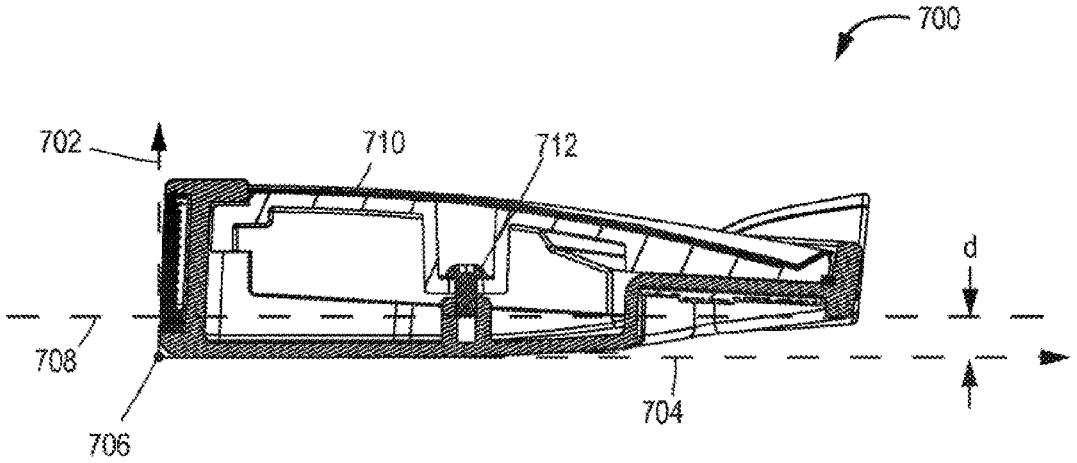
FIG. 7 illustrates a cross-sectional side view of a golf club head.
Figure 8:
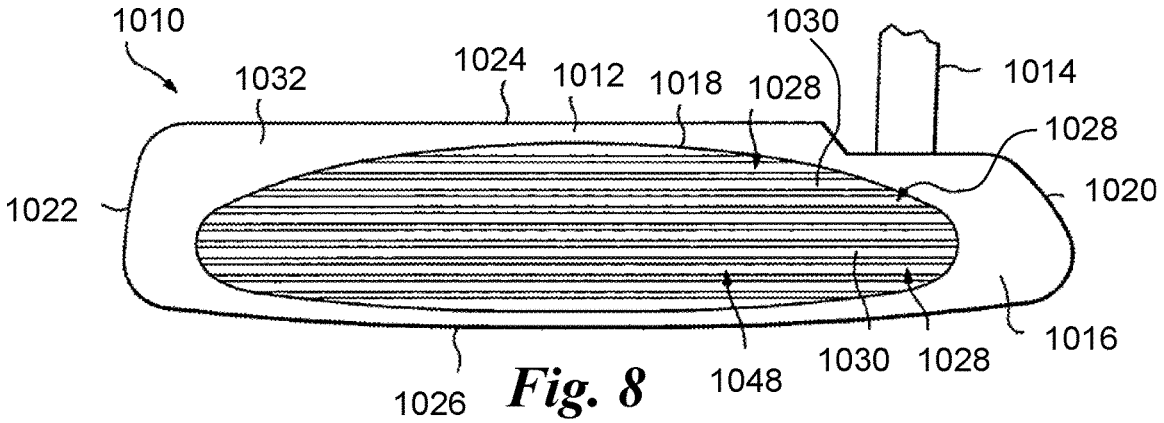
FIG. 8 is a front elevation view of a putter head having an insert mounted to the front surface of the head, according to one embodiment.
Figure 9:
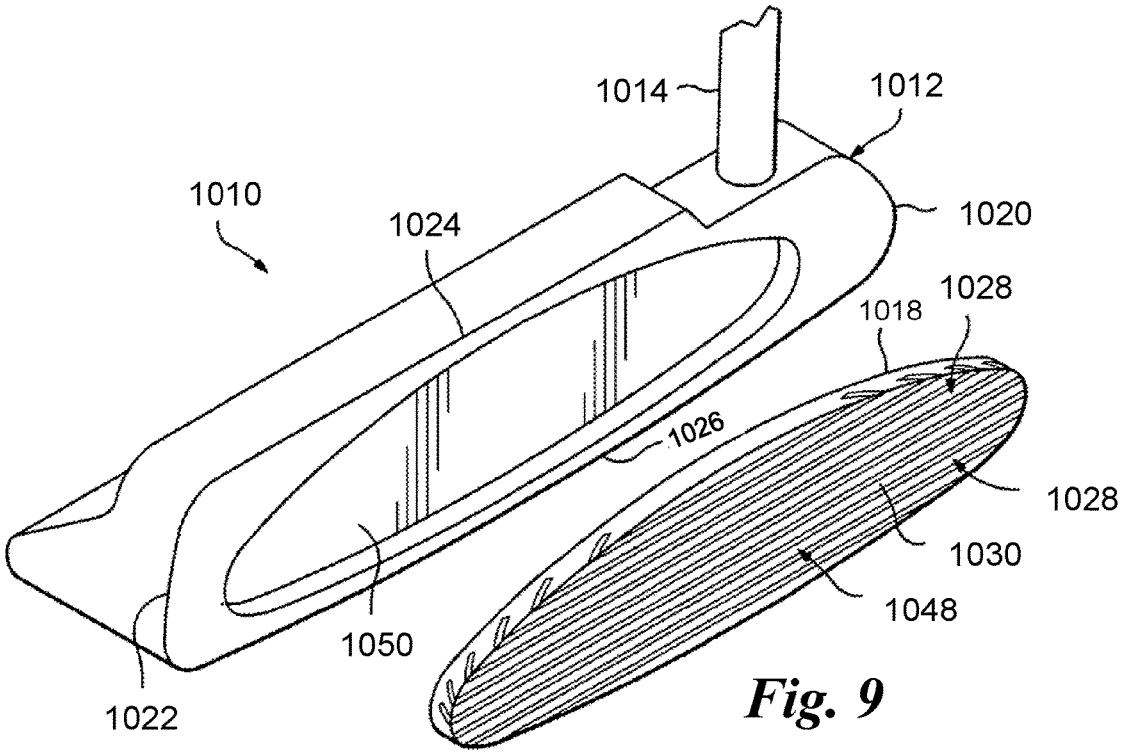
FIG. 9 is a perspective, exploded view of the putter head of FIG. 8.

FIG. 7 illustrates a cross-sectional side view taken along a centerline axis of the assembled putter head 700 at a square loft address position. An origin Y-axis 704 and origin Z-axis 702 are shown (the origin X-axis is not shown but extends out of the page) converging on the ground center point 706 as previously described.

An important advantage of the lightweight crown construction as described above is that a lower CG can be achieved. FIG. 7 shows an offset plane 708 which is a horizontal plane that is parallel with the origin XY plane.

In one embodiment, the lightweight crown 710 is entirely located above the offset plane 708 to ensure a lower CG is achieved. In one embodiment, the offset plane is offset a distance, d, from the origin XY-plane by 6 mm. Therefore, the lightweight crown assembly (excluding the fastening member 712) is located primarily above the offset plane 708 by a distance from the origin XY-plane (passing through the center point 706) of 6 mm or greater. In some embodiments, the offset distance, d, from the origin XY-plane can be about 2 mm or greater depending on the lightweight crown 710 construction.

At least one advantage of the embodiments described above is that a lightweight crown portion enables a lower CG and a more desirable effective footprint, actual footprint, inner portion weight ratio, central portion weight ratio, and footprint ratio to be achieved while maintaining a light overall club head weight. In addition, a high MOI can be achieved to reduce club head twisting upon impact.

Another advantage of the embodiments described above is that more forward roll is promoted and a lower and farther back center of gravity is achieved. An increase in forward roll decreases the possibility of the golf ball skipping or skidding across the ground surface during use.

Another advantage of the embodiments described above, is that a large moment of inertia construction will reduce the amount of twisting that occurs upon impact about the CG X, Y, and Z-axes. The embodiments described herein provide a weight efficient means to achieve a high MOI putter.

In the embodiments described herein, the $I_{zz}$ can be about 2,000-14,000 g·cm$^2$ and the $I_{xx}$ and $I_{yy}$ can be about 1,000-10,000 g·cm$^2$.

Materials

The components of the above described components disclosed in the present specification can be formed from any of various suitable metals, metal alloys, polymers, composites, or various combinations thereof.

In addition to those noted above, some examples of metals and metal alloys that can be used to form the components of the connection assemblies include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

Some examples of composites that can be used to form the components include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the components include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®).

Whereas the invention has been described in connection with representative embodiments, it will be understood that the invention is not limited to those embodiments. On the contrary, the invention is intended to encompass all modifications, alternatives, and equivalents as may fall within the spirit and scope of the invention, as defined by the appended claims.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

We claim:

1. A golf club putter head comprising:

a top portion, a sole portion, a front portion with a striking surface, a heel side portion, and a toe side portion, wherein the heel side portion and the toe side portion extend rearwardly from the front portion and initially diverge outwardly from the front portion before converging toward one another;

a central portion extending rearwardly from the front portion with a toe side gap separating a portion of the central portion from the toe side portion and extending through the sole portion and the top portion, and a heel side gap separating a portion of the central portion from the heel side portion and extending through the sole portion and the top portion;

a face portion plane intersects a horizontal ground plane to define a ground center location, a ground center X-axis, and a ground center Y-axis, with the ground center Y-axis separating a toe-side of the putter head from a heel-side of the putter head;

a center of gravity having a CG x-axis, a CG y-axis, and a CG z-axis;

a putter head geometric center;

a heel side outboard extension extending from the heel side portion and located at least partially behind a geometric center vertical plane containing the putter head geometric center and being parallel to the ground center X-axis;

a toe side outboard extension extending from the toe side portion and located at least partially behind the geometric center vertical plane;

a forward maximum external perimeter width between the opposed heel side portion and the toe side portion, measured parallel to the ground center X-axis, located at a forward maximum width location between the geometric center vertical plane and the striking surface;

a forward minimum external perimeter width between the opposed heel side portion and the toe side portion, measured parallel to the ground center X-axis, located at a forward minimum width location closer to the striking surface than the forward maximum width location, wherein the forward minimum external perimeter width is less than the forward maximum external perimeter width;

a rearward maximum external perimeter width between a heelwardmost point on the heel side outboard extension and a toewardmost point on the toe side outboard extension, measured parallel to the ground center X-axis;

a rearward minimum external perimeter width between the opposed heel side portion and the toe side portion, measured parallel to the ground center X-axis, located at a rearward minimum width location rearward of the forward maximum width location and forward of the rearward maximum external perimeter width, wherein the rearward minimum external perimeter width is less than the forward maximum external perimeter width, and the rearward minimum external perimeter width is less than the rearward maximum external perimeter width;

wherein:

a moment of inertia about the CG z-axis (Izz) of 4000-14000 $g \cdot cm^2$;

an effective footprint defined as an area occupied by an outermost silhouette of the golf club putter head projected onto a X-Y plane;

an actual footprint less than the effective footprint, and the actual footprint defined as an area occupied by an actual silhouette of the golf club putter head projected onto the X-Y plane; and a footprint ratio of 0.7-0.9, with the footprint ratio defined as the actual footprint divided by the effective footprint.

2. The golf club putter head of claim 1, wherein the forward minimum external perimeter width occurs at the striking surface, and a portion of the toe side gap and a portion of the heel side gap are located rearward of the CG x-axis.

3. The golf club putter head of claim 2, further comprising a heel-side weight attached to the heel-side of the putter head, and a toe-side weight attached to the toe-side of the putter head, wherein the rearward maximum external perimeter width is greater than the forward minimum external perimeter width, a portion of the toe side gap and a portion of the heel side gap are located rearward of the CG x-axis, and a portion of the heel side outboard extension and a portion of the toe side outboard extension are located rearward of the CG x-axis.

4. The golf club putter head of claim 2, further comprising a heel-side weight attached to the heel-side of the putter head, and a toe-side weight attached to the toe-side of the putter head, wherein the sole portion comprises a first sole region formed of a first sole material and a second sole region formed of a second sole material different than the first sole material, a portion of the toe side gap and a portion of the heel side gap are located rearward of the CG x-axis, and a portion of the heel side outboard extension and a portion of the toe side outboard extension are located rearward of the CG x-axis.

5. The golf club putter head of claim 1, wherein the toe side portion is formed of a toe side portion material, the striking surface includes a face insert comprising at least a first face insert material different material than the toe side portion material.

6. The golf club putter head of claim 5, wherein a portion of the toe side gap and a portion of the heel side gap are located rearward of the CG x-axis, the face insert includes a plurality of grooves, the face insert has a face insert contact surface, a face insert rear surface, and a face insert thickness measured from the face insert contact surface to the face insert rear surface, and the face insert comprises (a) a plurality of beams with each beam having an exterior beam surface at the face insert contact surface, a first-side surface extending from the face insert contact surface toward the face insert rear surface, a second-side surface extending from the face insert contact surface toward the face insert rear surface, and a beam thickness measured orthogonally from the first-side surface to the second-side surface, and (b) the plurality of grooves comprises a plurality of beam gaps with each beam gap having a beam gap width between two adjacent beams.

7. The golf club putter head of claim 6, wherein at least a portion of the heel side outboard extension and a portion of the toe side outboard extension are located rearward of the CG x-axis, and each beam has a maximum beam depth measured from the exterior beam surface to a deepest portion of an adjacent beam gap, and at least one beam of the plurality of beams has a first maximum beam depth of at least 1 mm, and at least one beam of the plurality of beams has an acute beam angle measured relative to the face insert rear surface.

8. The golf club putter head of claim 7, wherein the acute beam angle is 6-76 degrees, and the first face insert material is a polymeric material.

9. The golf club putter head of claim 1, wherein the striking surface includes a face insert comprising a polymeric material, the face insert includes a plurality of horizontal grooves, and at least one groove of the plurality of horizontal grooves has a groove surface angled downward at a 6-76 degree angle measured from a vertical axis.

10. A golf club putter head, comprising:

a golf club putter head geometric center;

a top portion;

a sole portion;

a face portion having a striking surface with a striking surface width and a geometric center separating a heel-side and a toe-side of the putter head, and the face portion comprising a face portion heel side and a face portion toe side;

a ground center location located near a bottom edge of the face portion, a ground center X-axis, a ground center Y-axis, a ground center Z-axis;

a head center of gravity (CG) having a CG X-axis, a CG Y-axis, and a CG Z-axis;

a back portion;

a first toe side portion extending rearwardly from the face portion toe side and flaring outwardly from the striking surface thereby diverging from the ground center Y-axis, and a second toe side portion extending rearwardly from the first toe side portion and joining the back portion;

a first heel side portion extending rearwardly from the face portion heel side and flaring outwardly from the striking surface thereby diverging from the ground center Y-axis, and a second heel side portion extending rearwardly from the first heel side portion and joining the back portion;

wherein the second toe side portion and the second heel side portion converge toward one another; and a central gap creating an opening extending through the sole portion and the top portion, wherein the central gap has a central gap geometric center and the central gap geometric center is positioned rearward of the head center of gravity; and wherein the golf club putter head has:

a CGy location of no more than 50 mm as measured from the ground center location along the ground center Y-axis;

a moment of inertia about the CG z-axis (Izz) that is at least 4,000 $g \cdot cm^2$ and no more than 14,000 $g \cdot cm^2$;

an effective footprint defined as an area occupied by an outermost silhouette of the golf club putter head projected onto an X-Y plane;

an actual footprint less than the effective footprint, wherein the actual footprint is defined as an area occupied by an actual silhouette of the golf club putter head projected onto the X-Y plane; and a footprint ratio of 0.7-0.9, with the footprint ratio defined as the actual footprint divided by the effective footprint.

11. The golf club putter head of claim 10, wherein the striking surface includes a face insert comprising a polymeric material, and the face insert includes a plurality of grooves.

12. The golf club putter head of claim 11, wherein the plurality of grooves are horizontal and at least one groove of the plurality of grooves has a groove surface angled downward at a 6-76 degree angle measured from a vertical axis.

13. The golf club putter head of claim 12, further comprising a heel-side weight attached to the heel-side of the putter head, and a toe-side weight attached to the toe-side of the putter head, wherein the sole portion comprises a first sole region formed of a first sole material and a second sole region formed of a second sole material different than the first sole material, the footprint ratio is 0.76-0.9, and the central gap geometric center is positioned rearward of the golf club putter head geometric center.

14. The golf club putter head of claim 10, further comprising:

a geometric center vertical plane containing the golf club putter head geometric center and parallel to the ground center X-axis;

a forward maximum external perimeter width between the opposed first heel side portion and the first toe side portion, measured parallel to the ground center X-axis, located at a forward maximum width location between the geometric center vertical plane and the striking surface;

a forward minimum external perimeter width between the opposed first heel side portion and the first toe side portion, measured parallel to the ground center X-axis, located at a forward minimum width location closer to the striking surface than the forward maximum width location, wherein the forward minimum external perimeter width is less than the forward maximum external perimeter width; and a rearward minimum external perimeter width between the opposed second heel side portion and the second toe side portion, measured parallel to the ground center X-axis, located at a rearward minimum width location, wherein the rearward minimum external perimeter width is less than the forward maximum external perimeter width.

15. The golf club putter head of claim 14, wherein the top portion is formed of a top portion material, and the face portion includes a face insert comprising at least a first face insert material different than the top portion material.

16. The golf club putter head of claim 15, wherein the face insert includes a plurality of grooves, the face insert has a face insert contact surface, a face insert rear surface, and a face insert thickness measured from the face insert contact surface to the face insert rear surface, and the face insert comprises (a) a plurality of beams with each beam of the plurality of beams having an exterior beam surface at the face insert contact surface, a first-side surface extending from the face insert contact surface toward the face insert rear surface, a second-side surface extending from the face insert contact surface toward the face insert rear surface, and a beam thickness measured orthogonally from the first-side surface to the second-side surface, and (b) the plurality of grooves comprises a plurality of beam gaps with each beam gap of the plurality of beam gaps having a beam gap width between two adjacent beams, and (c) at least one beam of the plurality of beams has an acute beam angle of 6-76 degrees, measured relative to the face insert contact surface.

17. The golf club putter head of claim 16, wherein the rearward minimum external perimeter width is less than the striking surface width, the face insert comprises a polymeric material, the acute beam angle is 26-56 degrees, the insert has an insert width, and at least one beam gap of the plurality of beam gaps extends less than the insert width.

18. The golf club putter head of claim 10, wherein the central gap geometric center is positioned rearward of the golf club putter head geometric center, and the striking surface includes a face insert comprising a titanium alloy.

19. The golf club putter head of claim 10, further comprising a heel-side weight attached to the heel-side of the putter head, and a toe-side weight attached to the toe-side of the putter head, wherein the central gap geometric center is positioned rearward of the golf club putter head geometric center.

20. The golf club putter head of claim 19, wherein the striking surface includes a face insert comprising a steel material, a portion of the striking surface comprises aluminum alloy material, a portion of the top portion comprises aluminum alloy material, and a portion of the sole portion comprises aluminum alloy material.

21. The golf club putter head of claim 19, further including a sole plate attached to the golf club putter head, the sole plate having a sole plate rear edge and a sole plate forward edge, wherein a portion of the sole plate rear edge is located rearward of the CG, a portion of the sole plate forward edge is located forward of the CG, the sole portion comprises a sole portion material, and the sole plate is formed of a sole plate material different than the sole portion material.

22. The golf club putter head of claim 21, wherein the central gap has a central gap forwardmost portion, a toewardmost portion of the sole plate is located rearward of the central gap forwardmost portion, and a heelwardmost portion of the sole plate is located rearward of the central gap forwardmost portion.

23. A golf club putter head, comprising:

a golf club putter head geometric center;

a head center of gravity (CG) having a CG X-axis, a CG Y-axis, and a CG Z-axis;

a top portion;

a sole portion having a sole opening and formed of a sole portion material;

a sole plate attached to the golf club putter head and closing the sole opening, the sole plate having a sole plate rear edge and a sole plate forward edge, wherein a portion of the sole plate rear edge is located rearward of the CG, a portion of the sole plate forward edge is located forward of the CG, and the sole plate is formed of a sole plate material different than the sole portion material;

a face portion having a striking surface with a striking surface width and a geometric center separating a heel side and a toe side of the golf club putter head, and the face portion comprising a face portion heel side and a face portion toe side;

a face insert attached to a portion of the face portion;

a ground center location located near a bottom edge of the face portion, a ground center X-axis, a ground center Y-axis, a ground center Z-axis;

a first toe side portion extending rearwardly from the face portion toe side and flaring outwardly from the striking surface thereby diverging from the ground center Y-axis, and a second toe side portion extending rearwardly from the first toe side portion;

a first heel side portion extending rearwardly from the face portion heel side and flaring outwardly from the striking surface thereby diverging from the ground center Y-axis, and a second heel side portion extending rearwardly from the first heel side portion;

a heel side outboard extension extending from the second heel side portion and at least partially located rearward of the head center of gravity;

a toe side outboard extension extending from the second toe side portion and at least partially located rearward of the head center of gravity; and a rearward maximum external perimeter width between a heelwardmost point on the heel side outboard extension and a toewardmost point on the toe side outboard extension, measured parallel to the ground center X-axis;

a geometric center vertical plane containing the golf club putter head geometric center and parallel to the ground center X-axis;

a rearward minimum external perimeter width between the opposed second heel side portion and the second toe side portion, measured parallel to the ground center X-axis, located at a rearward minimum width location rearward of the geometric center vertical plane and forward of the rearward maximum external perimeter width, wherein the rearward minimum external perimeter width is less than the rearward maximum external perimeter width;

wherein the second toe side portion and the second heel side portion converge toward one another; and wherein the golf club putter head has a moment of inertia about the CG z-axis (Izz) that is at least 4,000 g $cm^2$ and no more than 14,000 g $cm^2$.

24. The golf club putter head of claim 23, wherein at least a portion of the heel side outboard extension and a portion of the toe side outboard extension are located rearward of the CG X-axis, the face insert includes a plurality of grooves, the face insert has a face insert contact surface, a face insert rear surface, and a face insert thickness measured from the face insert contact surface to the face insert rear surface, and the face insert comprises (a) a plurality of beams with each beam having an exterior beam surface at the face insert contact surface, a first-side surface extending from the face insert contact surface toward the face insert rear surface, a second-side surface extending from the face insert contact surface toward the face insert rear surface, and a beam thickness measured orthogonally from the first-side surface to the second-side surface, and (b) the plurality of grooves comprises a plurality of beam gaps with each beam gap having a beam gap width between two adjacent beams.

25. The golf club putter head of claim 24, further comprising:

a forward maximum external perimeter width between the opposed first heel side portion and the first toe side portion, measured parallel to the ground center X-axis, located at a forward maximum width location between the geometric center vertical plane and the striking surface; and wherein the rearward minimum external perimeter width is less than the forward maximum external perimeter width, and at least one beam of the plurality of beams has an acute beam angle measured relative to the face insert rear surface.

26. The golf club putter head of claim 25, further comprising:

a forward minimum external perimeter width between the opposed first heel side portion and the first toe side portion, measured parallel to the ground center X-axis, located at a forward minimum width location closer to the striking surface than the forward maximum width location, wherein the forward minimum external perimeter width is less than the forward maximum external perimeter width; and wherein the acute beam angle is 6-76 degrees.

27. The golf club putter head of claim 26, further comprising:

one or more gaps;

an effective footprint defined as an area occupied by an outermost silhouette of the golf club putter head projected onto an X-Y plane;

an actual footprint less than the effective footprint, wherein the actual footprint is defined as an area occupied by an actual silhouette of the golf club putter head projected onto the X-Y plane; and a footprint ratio of 0.7-0.9, with the footprint ratio defined as the actual footprint divided by the effective footprint.

28. The golf club putter head of claim 23, wherein the face insert comprises a polymeric material, and the face insert includes a plurality of grooves.

29. The golf club putter head of claim 28, wherein the plurality of grooves are horizontal and at least one groove of the plurality of grooves has a groove surface angled downward at a 6-76 degree angle measured from a vertical axis.

30. The golf club putter head of claim 28, further comprising a heel-side weight attached to the heel-side of the putter head, and a toe-side weight attached to the toe-side of the putter head.

31. The golf club putter head of claim 23, further comprising:

a toe side gap extending through the sole portion and the top portion;

a heel side gap extending through the sole portion and the top portion;

wherein a portion of the sole plate rear edge is located rearward of the toe side gap and rearward of the heel side gap; and wherein a portion of the toe side gap is located rearward of the geometric center vertical plane, and a portion of the heel side gap is located rearward of the geometric center vertical plane.

32. The golf club putter head of claim 31, wherein the sole plate comprises an aluminum alloy material.

33. The golf club putter head of claim 31, wherein the sole plate comprises a polymer material.

34. The golf club putter head of claim 31, wherein the face insert includes a plurality of grooves.

35. The golf club putter head of claim 34, wherein the plurality of grooves are horizontal and at least one groove of the plurality of grooves has a groove surface angled downward at a 6-76 degree angle measured from a vertical axis, wherein:

an effective footprint defined as an area occupied by an outermost silhouette of the golf club putter head projected onto a X-Y plane;

an actual footprint less than the effective footprint, and the actual footprint defined as an area occupied by an actual silhouette of the golf club putter head projected onto the X-Y plane; and a footprint ratio of 0.7-0.9, with the footprint ratio defined as the actual footprint-divided by the effective footprint.

* * * * *